US008454322B2

(12) United States Patent
Gammack et al.

(10) Patent No.: US 8,454,322 B2
(45) Date of Patent: Jun. 4, 2013

(54) FAN HAVING A MAGNETICALLY ATTACHED REMOTE CONTROL

(75) Inventors: Peter David Gammack, Malmesbury (GB); James Dyson, Malmesbury (GB); Arran George Smith, Malmesbury (GB); Ian John Brough, Malmesbury (GB); Mon Shy Teyu, Johor (MY); Noorhazelinda Mohd.Salleh, Johor (MY)

(73) Assignee: Dyson Technology Limited, Malmesbury (GB)

( * ) Notice: Subject to any disclaimer, the term of this patent is extended or adjusted under 35 U.S.C. 154(b) by 291 days.

(21) Appl. No.: 12/917,247

(22) Filed: Nov. 1, 2010

(65) Prior Publication Data

US 2011/0110805 A1 May 12, 2011

(30) Foreign Application Priority Data

Nov. 6, 2009 (GB) ..... 0919473.9

(51) Int. Cl.
*F04F 9/00* (2006.01)
*F04B 53/00* (2006.01)

(52) U.S. Cl.
USPC ..... 417/158; 417/572

(58) Field of Classification Search
USPC ..... 417/158, 151, 572
See application file for complete search history.

(56) References Cited

U.S. PATENT DOCUMENTS

| | | | |
|---|---|---|---|
| 1,357,261 | A | 11/1920 | Svoboda |
| 1,767,060 | A | 6/1930 | Ferguson |
| 1,896,869 | A | 2/1933 | Larsh |
| 2,014,185 | A | 9/1935 | Martin |
| 2,035,733 | A | 3/1936 | Wall |
| D103,476 | S | 3/1937 | Weber |
| 2,115,883 | A | 5/1938 | Sher |
| D115,344 | S | 6/1939 | Chapman |
| 2,210,458 | A | 8/1940 | Keilholtz |
| 2,258,961 | A | 10/1941 | Saathoff |
| 2,336,295 | A | 12/1943 | Reimuller |
| 2,433,795 | A | 12/1947 | Stokes |

(Continued)

FOREIGN PATENT DOCUMENTS

| | | |
|---|---|---|
| BE | 560119 | 8/1957 |
| CA | 1055344 | 5/1979 |

(Continued)

OTHER PUBLICATIONS

Gammack, P. et al. U.S. Office Action mailed May 13, 2011, directed to U.S. Appl. No. 12/230,613; 13 pages.

(Continued)

*Primary Examiner* — Charles Freay
(74) *Attorney, Agent, or Firm* — Morrison & Foerster LLP

(57) ABSTRACT

A fan assembly for creating an air current includes an air inlet, an air outlet, an impeller, a motor for rotating the impeller to create an air flow passing from the air inlet to the air outlet, the air outlet comprising an interior passage for receiving the air flow and a mouth for emitting the air flow, the air outlet defining an opening through which air from outside the fan assembly is drawn by the air flow emitted from the mouth, a control circuit for controlling the motor, a remote control for transmitting control signals to the control circuit, and at least one magnet for attaching the remote control to the air outlet.

16 Claims, 12 Drawing Sheets

U.S. PATENT DOCUMENTS 2,473,325 A 6/1949 Aufiero
2,476,002 A 7/1949 Stalker
2,488,467 A 11/1949 De Lisio
2,510,132 A 6/1950 Morrison
2,544,379 A 3/1951 Davenport
2,547,448 A 4/1951 Demuth
2,583,374 A 1/1952 Hoffman
2,620,127 A 12/1952 Radcliffe
2,765,977 A 10/1956 Morrison
2,808,198 A 10/1957 Morrison
2,813,673 A 11/1957 Smith
2,830,779 A 4/1958 Wentling
2,838,229 A 6/1958 Belanger
2,922,277 A 1/1960 Bertin
2,922,570 A 1/1960 Allen
3,004,403 A 10/1961 Laporte
3,047,208 A 7/1962 Coanda
3,270,655 A 9/1966 Guirl et al.
D206,973 S 2/1967 De Lisio
3,503,138 A 3/1970 Fuchs et al.
3,518,776 A 7/1970 Wolff et al.
3,724,092 A 4/1973 McCleerey
3,743,186 A 7/1973 Mocarski
3,795,367 A 3/1974 Mocarski
3,872,916 A 3/1975 Beck
3,875,745 A 4/1975 Franklin
3,885,891 A 5/1975 Throndson
3,943,329 A 3/1976 Hlavac
4,037,991 A 7/1977 Taylor
4,046,492 A 9/1977 Inglis
4,061,188 A 12/1977 Beck
4,073,613 A 2/1978 Desty
4,113,416 A 9/1978 Kataoka et al.
4,136,735 A 1/1979 Beck et al.
4,173,995 A 11/1979 Beck
4,180,130 A 12/1979 Beck et al.
4,184,541 A 1/1980 Beck et al.
4,192,461 A 3/1980 Arborg
4,332,529 A 6/1982 Alperin
4,336,017 A 6/1982 Desty
4,342,204 A 8/1982 Melikian et al.
4,448,354 A 5/1984 Reznick et al.
4,568,243 A 2/1986 Schubert et al.
4,630,475 A 12/1986 Mizoguchi
4,643,351 A 2/1987 Fukamachi et al.
4,703,152 A 10/1987 Shih-Chin
4,718,870 A 1/1988 Watts
4,732,539 A 3/1988 Shin-Chin
4,790,133 A 12/1988 Stuart
4,850,804 A 7/1989 Huang
4,878,620 A 11/1989 Tarleton
4,893,990 A 1/1990 Tomohiro et al.
4,978,281 A 12/1990 Conger, IV
5,061,405 A 10/1991 Stanek et al.
D325,435 S 4/1992 Coup et al.
5,168,722 A 12/1992 Brock
5,176,856 A 1/1993 Takahashi et al.
5,188,508 A 2/1993 Scott et al.
5,296,769 A 3/1994 Havens et al.
5,310,313 A 5/1994 Chen
5,317,815 A 6/1994 Hwang
5,402,938 A 4/1995 Sweeney
5,407,324 A 4/1995 Starnes, Jr. et al.
5,425,902 A 6/1995 Miller et al.
5,518,370 A 5/1996 Wang et al.
5,609,473 A 3/1997 Litvin
5,645,769 A 7/1997 Tamaru et al.
5,649,370 A 7/1997 Russo
5,735,683 A 4/1998 Muschelknautz
5,762,034 A 6/1998 Foss
5,762,661 A 6/1998 Kleinberger et al.
5,783,117 A 7/1998 Byassee et al.
D398,983 S 9/1998 Keller et al.
5,841,080 A 11/1998 Iida et al.
5,843,344 A 12/1998 Junket et al.
5,862,037 A 1/1999 Behl
5,868,197 A 2/1999 Potier
5,881,685 A 3/1999 Foss et al.
D415,271 S 10/1999 Feer
6,015,274 A 1/2000 Bias et al.
6,073,881 A 6/2000 Chen
D429,808 S 8/2000 Krauss et al.
6,123,618 A 9/2000 Day
6,155,782 A 12/2000 Hsu
D435,899 S 1/2001 Melwani
6,254,337 B1 7/2001 Arnold
6,269,549 B1 8/2001 Carlucci et al.
6,278,248 B1 8/2001 Hong et al.
6,282,746 B1 9/2001 Schleeter
6,293,121 B1 9/2001 Labrador
6,321,034 B2 11/2001 Jones-Lawlor et al.
6,386,845 B1 5/2002 Bedard
6,480,672 B1 11/2002 Rosenzweig et al.
6,599,088 B2 7/2003 Stagg
D485,895 S 1/2004 Melwani
6,789,787 B2 9/2004 Stutts
6,830,433 B2 12/2004 Birdsell et al.
7,059,826 B2 6/2006 Lasko
7,088,913 B1 8/2006 Verhoorn et al.
7,147,336 B1 12/2006 Chou
D539,414 S 3/2007 Russak et al.
7,478,993 B2 1/2009 Hong et al.
7,540,474 B1 6/2009 Huang et al.
D598,532 S 8/2009 Dyson et al.
D602,143 S 10/2009 Gammack et al.
D602,144 S 10/2009 Dyson et al.
D605,748 S 12/2009 Gammack et al.
7,664,377 B2 2/2010 Liao
D614,280 S 4/2010 Dyson et al.
7,775,848 B1 8/2010 Auerbach
7,806,388 B2 10/2010 Junkel et al.
8,092,166 B2 * 1/2012 Nicolas et al. ..... 415/209.2
2002/0106547 A1 8/2002 Sugawara et al.
2003/0059307 A1 3/2003 Moreno et al.
2003/0171093 A1 9/2003 Gumucio Del Pozo
2004/0022631 A1 2/2004 Birdsell et al.
2004/0049842 A1 3/2004 Prehodka
2004/0149881 A1 8/2004 Allen
2005/0031448 A1 2/2005 Lasko et al.
2005/0053465 A1 3/2005 Roach et al.
2005/0069407 A1 3/2005 Winkler et al.
2005/0128698 A1 6/2005 Huang
2005/0163670 A1 7/2005 Alleyne et al.
2005/0173997 A1 8/2005 Schmid et al.
2005/0281672 A1 12/2005 Parker et al.
2006/0172682 A1 8/2006 Orr et al.
2006/0199515 A1 9/2006 Lasko et al.
2007/0035189 A1 2/2007 Matsumoto
2007/0041857 A1 2/2007 Fleig
2007/0065280 A1 3/2007 Fok
2007/0166160 A1 7/2007 Russak et al.
2007/0176502 A1 8/2007 Kasai et al.
2007/0224044 A1 9/2007 Hong et al.
2007/0269323 A1 11/2007 Zhou et al.
2008/0020698 A1 1/2008 Spaggiari
2008/0152482 A1 6/2008 Patel
2008/0166224 A1 7/2008 Giffin
2008/0286130 A1 11/2008 Purvines
2008/0314250 A1 12/2008 Cowie et al.
2009/0026850 A1 1/2009 Fu
2009/0032130 A1 2/2009 Dumas et al.
2009/0039805 A1 2/2009 Tang
2009/0060710 A1 3/2009 Gammack et al.
2009/0060711 A1 3/2009 Gammack et al.
2009/0120925 A1 5/2009 Lasko
2009/0191054 A1 7/2009 Winkler
2009/0214341 A1 8/2009 Craig
2010/0150699 A1 6/2010 Nicolas et al.
2010/0162011 A1 6/2010 Min
2010/0171465 A1 7/2010 Seal et al.
2010/0225012 A1 9/2010 Fitton et al.
2010/0226749 A1 9/2010 Gammack et al.
2010/0226750 A1 9/2010 Gammack
2010/0226751 A1 9/2010 Gammack et al.
2010/0226752 A1 9/2010 Gammack et al.
2010/0226753 A1 9/2010 Dyson et al.
2010/0226754 A1 9/2010 Hutton et al.

| | | | |
|---|---|---|---|
| 2010/0226758 | A1 | 9/2010 | Cookson et al. |
| 2010/0226763 | A1 | 9/2010 | Gammack et al. |
| 2010/0226764 | A1 | 9/2010 | Gammack et al. |
| 2010/0226769 | A1 | 9/2010 | Helps |
| 2010/0226771 | A1 | 9/2010 | Crawford et al. |
| 2010/0226787 | A1 | 9/2010 | Gammack et al. |
| 2010/0226797 | A1 | 9/2010 | Fitton et al. |
| 2010/0226801 | A1 | 9/2010 | Gammack |
| 2010/0254800 | A1 | 10/2010 | Fitton et al. |
| 2011/0164959 | A1 | 7/2011 | Fitton et al. |
| 2011/0223014 | A1 | 9/2011 | Crawford et al. |
| 2011/0223015 | A1 | 9/2011 | Gammack et al. |
| 2012/0031509 | A1 | 2/2012 | Wallace et al. |
| 2012/0033952 | A1 | 2/2012 | Wallace et al. |
| 2012/0034108 | A1 | 2/2012 | Wallace et al. |
| 2012/0039705 | A1 | 2/2012 | Gammack |
| 2012/0045315 | A1 | 2/2012 | Gammack |
| 2012/0045316 | A1 | 2/2012 | Gammack |
| 2012/0057959 | A1 | 3/2012 | Hodgson et al. |
| 2012/0082561 | A1 | 4/2012 | Gammack et al. |
| 2012/0093629 | A1 | 4/2012 | Fitton et al. |
| 2012/0093630 | A1 | 4/2012 | Fitton et al. |
| 2012/0230658 | A1 | 9/2012 | Fitton et al. |

FOREIGN PATENT DOCUMENTS

| | | |
|---|---|---|
| CA | 2155482 | 9/1996 |
| CH | 346643 | 5/1960 |
| CN | 2085866 | 10/1991 |
| CN | 2111392 | 7/1992 |
| CN | 1437300 | 8/2003 |
| CN | 2650005 | 10/2004 |
| CN | 2713643 | 7/2005 |
| CN | 1680727 | 10/2005 |
| CN | 2833197 | 11/2006 |
| CN | 201180678 | 1/2009 |
| CN | 201221477 | 4/2009 |
| CN | 201281416 | 7/2009 |
| CN | 201349269 | 11/2009 |
| CN | 101749288 | 6/2010 |
| CN | 201502549 | 6/2010 |
| CN | 201568337 | 9/2010 |
| CN | 101936310 | 1/2011 |
| CN | 101984299 | 3/2011 |
| CN | 101985948 | 3/2011 |
| CN | 201763705 | 3/2011 |
| CN | 201763706 | 3/2011 |
| CN | 201770513 | 3/2011 |
| CN | 201779080 | 3/2011 |
| CN | 201802648 | 4/2011 |
| CN | 102095236 | 6/2011 |
| CN | 102367813 | 3/2012 |
| DE | 1 291 090 | 3/1969 |
| DE | 24 51 557 | 5/1976 |
| DE | 27 48 724 | 5/1978 |
| DE | 3644567 | 7/1988 |
| DE | 19510397 | 9/1996 |
| DE | 197 12 228 | 10/1998 |
| DE | 100 00 400 | 3/2001 |
| DE | 10041805 | 6/2002 |
| DE | 10 2009 007 037 | 8/2010 |
| EP | 0 044 494 | 1/1982 |
| EP | 0186581 | 7/1986 |
| EP | 1 094 224 | 4/2001 |
| EP | 1 138 954 | 10/2001 |
| EP | 1 779 745 | 5/2007 |
| EP | 1 939 456 | 7/2008 |
| EP | 1 980 432 | 10/2008 |
| EP | 2 000 675 | 12/2008 |
| EP | 2191142 | 6/2010 |
| FR | 1033034 | 7/1953 |
| FR | 1119439 | 6/1956 |
| FR | 1.387.334 | 1/1965 |
| FR | 2 534 983 | 4/1984 |
| FR | 2 640 857 | 6/1990 |
| FR | 2 658 593 | 8/1991 |
| FR | 2794195 | 12/2000 |
| FR | 2 874 409 | 2/2006 |
| FR | 2 906 980 | 4/2008 |
| FR | 2928706 | 9/2009 |
| GB | 22235 | 6/1914 |
| GB | 383498 | 11/1932 |
| GB | 593828 | 10/1947 |
| GB | 601222 | 4/1948 |
| GB | 633273 | 12/1949 |
| GB | 641622 | 8/1950 |
| GB | 661747 | 11/1951 |
| GB | 863 124 | 3/1961 |
| GB | 1067956 | 5/1967 |
| GB | 1262131 | 2/1972 |
| GB | 1265341 | 3/1972 |
| GB | 1 278 606 | 6/1972 |
| GB | 1 304 560 | 1/1973 |
| GB | 1 403 188 | 8/1975 |
| GB | 1 434 226 | 5/1976 |
| GB | 1501473 | 2/1978 |
| GB | 2 094 400 | 9/1982 |
| GB | 2 107 787 | 5/1983 |
| GB | 2 111 125 | 6/1983 |
| GB | 2 178 256 | 2/1987 |
| GB | 2 185 533 | 7/1987 |
| GB | 2185531 | 7/1987 |
| GB | 2 218 196 | 11/1989 |
| GB | 2236804 | 4/1991 |
| GB | 2 240 268 | 7/1991 |
| GB | 2242935 | 10/1991 |
| GB | 2 285 504 | 7/1995 |
| GB | 2 289 087 | 11/1995 |
| GB | 2383277 | 6/2003 |
| GB | 2 428 569 | 2/2007 |
| GB | 2 452 593 | 3/2009 |
| GB | 2452490 | 3/2009 |
| GB | 2463698 | 3/2010 |
| GB | 2464736 | 4/2010 |
| GB | 2466058 | 6/2010 |
| GB | 2468369 | 8/2010 |
| GB | 2468312 | 9/2010 |
| GB | 2468313 | 9/2010 |
| GB | 2468315 | 9/2010 |
| GB | 2468319 | 9/2010 |
| GB | 2468320 | 9/2010 |
| GB | 2468323 | 9/2010 |
| GB | 2468328 | 9/2010 |
| GB | 2468331 | 9/2010 |
| GB | 2473037 | 3/2011 |
| GB | 2479760 | 10/2011 |
| GB | 2482547 | 2/2012 |
| JP | 31-13055 | 8/1956 |
| JP | 35-4369 | 3/1960 |
| JP | 39-7297 | 3/1964 |
| JP | 49-150403 | 12/1974 |
| JP | 51-7258 | 1/1976 |
| JP | 53-60100 | 5/1978 |
| JP | 56-167897 | 12/1981 |
| JP | 57-71000 | 5/1982 |
| JP | 57-157097 | 9/1982 |
| JP | 61-31830 | 2/1986 |
| JP | 61-116093 | 6/1986 |
| JP | 61-280787 | 12/1986 |
| JP | 62-223494 | 10/1987 |
| JP | 63-179198 | 7/1988 |
| JP | 63-306340 | 12/1988 |
| JP | 64-21300 U | 2/1989 |
| JP | 64-83884 | 3/1989 |
| JP | 1-138399 | 5/1989 |
| JP | 1-224598 | 9/1989 |
| JP | 2-146294 | 6/1990 |
| JP | 2-218890 | 8/1990 |
| JP | 2-248690 | 10/1990 |
| JP | 3-52515 | 5/1991 |
| JP | 3-267598 | 11/1991 |
| JP | 4-43895 | 2/1992 |
| JP | 4-366330 | 12/1992 |
| JP | 5-157093 | 6/1993 |
| JP | 5-164089 | 6/1993 |
| JP | 5-263786 | 10/1993 |
| JP | 6-74190 | 3/1994 |

| | | |
|---|---|---|
| JP | 6-86898 | 3/1994 |
| JP | 6-147188 | 5/1994 |
| JP | 6-257591 | 9/1994 |
| JP | 6-280800 | 10/1994 |
| JP | 6-336113 | 12/1994 |
| JP | 7-190443 | 7/1995 |
| JP | 8-21400 | 1/1996 |
| JP | 9-100800 | 4/1997 |
| JP | 9-287600 | 11/1997 |
| JP | 11-227866 | 8/1999 |
| JP | 2000-116179 | 4/2000 |
| JP | 2000-201723 | 7/2000 |
| JP | 2001-17358 | 1/2001 |
| JP | 2002-21797 | 1/2002 |
| JP | 2002-138829 | 5/2002 |
| JP | 2002-213388 | 7/2002 |
| JP | 2003-329273 | 11/2003 |
| JP | 2004-8275 | 1/2004 |
| JP | 2004-208935 | 7/2004 |
| JP | 2004-216221 | 8/2004 |
| JP | 2005-201507 | 7/2005 |
| JP | 2005-307985 | 11/2005 |
| JP | 2006-89096 | 4/2006 |
| JP | 3127331 | 11/2006 |
| JP | 2007-138763 | 6/2007 |
| JP | 2007-138789 | 6/2007 |
| JP | 2008-39316 | 2/2008 |
| JP | 2008-100204 | 5/2008 |
| JP | 3146538 | 10/2008 |
| JP | 2008-294243 | 12/2008 |
| JP | 2009-44568 | 2/2009 |
| JP | 2010-131259 | 6/2010 |
| KR | 10-2005-0102317 | 10/2005 |
| KR | 2007-0007997 | 1/2007 |
| KR | 10-2010-0055611 | 5/2010 |
| KR | 10-0985378 | 9/2010 |
| TW | M394383 | 12/2010 |
| TW | M407299 | 7/2011 |
| WO | WO 90/13478 | 11/1990 |
| WO | WO-02/073096 | 9/2002 |
| WO | WO 03/058795 | 7/2003 |
| WO | WO-03/069931 | 8/2003 |
| WO | WO-2005/050026 | 6/2005 |
| WO | WO 2005/057091 | 6/2005 |
| WO | WO-2006/008021 | 1/2006 |
| WO | WO-2006/012526 | 2/2006 |
| WO | WO 2007/024955 | 3/2007 |
| WO | WO 2007/048205 | 5/2007 |
| WO | WO 2008/014641 | 2/2008 |
| WO | WO-2008/024569 | 2/2008 |
| WO | WO-2008/139491 | 11/2008 |
| WO | WO-2009/030879 | 3/2009 |
| WO | WO-2009/030881 | 3/2009 |
| WO | WO-2010/100451 | 9/2010 |
| WO | WO-2010/100452 | 9/2010 |
| WO | WO-2010/100453 | 9/2010 |
| WO | WO-2010/100462 | 9/2010 |

OTHER PUBLICATIONS

Third Party Submission Under 37 CFR 1.99 filed Jun. 2, 2011, directed towards U.S. Appl. No. 12/203,698; 3 pages.
Reba, I., (Jun. 1966),"Applications of the Coanda Effect," *Scientific American.*214:84-92.
GB Search Report dated Feb. 23, 2010, directed to GB Patent Application No. 0919473.9; 1 page.
Gammack, P. et al., U.S. Office Action mailed Apr. 12, 2011, directed to U.S. Appl. No. 12/716,749; 8 pages.
Gammack, P. et al., U.S. Office Action mailed Sep. 1, 2011, directed to U.S. Appl. No. 12/716,749; 9 pages.
Gammack, P. et al., U.S. Office Action mailed May 24, 2011, directed to U.S. Appl. No. 12/716,613; 9 pages.
Fitton et al., U.S. Office Action mailed Mar. 30, 2012, directed to U.S. Appl. No. 12/716,707; 7 pages.
Gammack, P. et al., U.S. Office Action mailed Jun. 8, 2012, directed to U.S. Appl. No. 12/230,613; 15 pages.
Gammack, P. et al., U.S. Office Action mailed Jun. 25, 2012, directed to U.S. Appl. No. 12/716,749; 11 pages.
Gammack, P. et al., U.S. Office Action mailed Jun. 21, 2011, directed to U.S. Appl. No. 12/203,698; 11 pages.
Gammack, P. et al., U.S. Office Action mailed Jun. 24, 2011, directed to U.S. Appl. No. 12/716,781; 19 pages.
Gammack, P. et al., U.S. Office Action mailed Sep. 7, 2011, directed to U.S. Appl. No. 12/230,613; 15 pages.
Nicolas, F. et al., U.S. Office Action mailed Sep. 8, 2011, directed to U.S. Appl. No. 12/622,844; 11 pages.
Fitton, et al., U.S. Office Action mailed Sep. 6, 2011, directed to U.S. Appl. No. 12/716,780; 16 pages.
Gammack et al., U.S. Appl. No. 12/945,558, filed Nov. 12, 2010; 23 pages.
Fitton et al., U.S. Office Action mailed Nov. 30, 2010 directed to U.S. Appl. No. 12/560,232; 9 pages.
Gammack, P. et al., U.S. Office Action mailed Dec. 9, 2010, directed to U.S. Appl. No. 12/203,698; 10 pages.
Gammack, P. et al., U.S. Office Action mailed Dec. 9, 2010, directed to U.S. Appl. No. 12/716,781; 17 pages.
Gammack, P. et al., U.S. Office Action mailed Dec. 10, 2010, directed to U.S. Appl. No. 12/230,613; 12 pages.
International Search Report and Written Opinion mailed Mar. 23, 2011, directed to International Patent Application No. PCT/GB2010/051793; 10 pages.
Simmonds, K. J. et al. U.S. Appl. No. 13/125,742, filed Apr. 22, 2011; 20 pages.
Nicolas, F. et al., U.S. Office Action mailed Mar. 7, 2011, directed to U.S. Appl. No. 12/622,844; 10 pages.
Fitton, N. G. et al., U.S. Office Action mailed Mar. 8, 2011, directed to U.S. Appl. No. 12/716,780; 12 pages.
Gammack et al., Office Action mailed Sep. 17, 2012, directed to U.S. Appl. No. 13/114,707; 12 pages.
Gammack et al., U.S. Office Action mailed Aug. 20, 2012, directed to U.S. Appl. No. 12/945,558; 15 pages.

* cited by examiner

FAN HAVING A MAGNETICALLY ATTACHED REMOTE CONTROL

REFERENCE TO RELATED APPLICATIONS

This application claims the priority of United Kingdom Application No. 0919473.9 filed Nov. 6, 2009, the entire contents of which are incorporated herein by reference.

FIELD OF THE INVENTION

The present invention relates to a fan assembly. In a preferred embodiment, the present invention relates to a domestic fan, such as a pedestal fan, for creating an air current in a room, office or other domestic environment.

BACKGROUND OF THE INVENTION

A conventional domestic fan typically includes a set of blades or vanes mounted for rotation about an axis, and drive apparatus for rotating the set of blades to generate an air flow. The movement and circulation of the air flow creates a 'wind chill' or breeze and, as a result, the user experiences a cooling effect as heat is dissipated through convection and evaporation.

Such fans are available in a variety of sizes and shapes. For example, a ceiling fan can be at least 1 m in diameter, and is usually mounted in a suspended manner from the ceiling to provide a downward flow of air to cool a room. On the other hand, desk fans are often around 30 cm in diameter, and are usually free standing and portable. Floor-standing pedestal fans generally comprise a height adjustable pedestal supporting the drive apparatus and the set of blades for generating an air flow, usually in the range from 300 to 500 l/s.

A disadvantage of this type of arrangement is that the air flow produced by the rotating blades of the fan is generally not uniform. This is due to variations across the blade surface or across the outward facing surface of the fan. The extent of these variations can vary from product to product and even from one individual fan machine to another.

These variations result in the generation of an uneven or 'choppy' air flow which can be felt as a series of pulses of air and which can be uncomfortable for a user.

In a domestic environment it is undesirable for parts of the appliance to project outwardly, or for a user to be able to touch any moving parts, such as the blades. Pedestal fans tend to have a cage surrounding the blades to prevent injury from contact with the rotating blades, but such caged parts can be difficult to clean. Furthermore, due to the mounting of the drive apparatus and the rotary blades on the top of the pedestal, the center of gravity of a pedestal fan is usually located towards the top of the pedestal. This can render the pedestal fan prone to falling if accidentally knocked unless the pedestal is provided with a relatively wide or heavy base, which may be undesirable for a user.

It is known, for example from JP5-263786 and JP6-257591 to provide a remote control for controlling the operation of a pedestal fan. The remote control may be used to switch the fan off and on, and to control the rotational speed of the blades of the fan. The base of the pedestal fan may be provided with a docking station or housing for storing the remote control when it is not in use. However, the presence of such a docking station can detract from the physical appearance of the pedestal fan, and may be awkward to access depending on the location of the fan and the proximity of items of furniture or other objects around the pedestal fan.

SUMMARY OF THE INVENTION

In a first aspect the present invention provides a fan assembly for creating an air current, the fan assembly comprising an air inlet, an air outlet, an impeller, a motor for rotating the impeller to create an air flow passing from the air inlet to the air outlet, the air outlet comprising an interior passage for receiving the air flow and a mouth for emitting the air flow, the air outlet defining an opening through which air from outside the fan assembly is drawn by the air flow emitted from the mouth, a control circuit for controlling the motor, a remote control for transmitting control signals to the control circuit, and magnetic means for attaching the remote control to the air outlet.

Through attaching the remote control to the air outlet, the accessibility of the remote control can be improved in comparison to a known pedestal fan in which the remote control is docked in the base of the fan. Furthermore, the requirement for a docking station or housing for retaining the remote control is avoided through the use of magnetic means for attracting the remote control to the air outlet, enabling the air outlet to have a uniform appearance.

The magnetic means is preferably arranged so that the force required to remove the remote control from the air outlet is less than 2 N, more preferably less than 1 N. For example, this force may be in the range from 0.25 to 1 N. This can minimize the likelihood of the fan assembly being displaced as the remote control is detached from the air outlet. To further improve access to the remote control, the magnetic means is preferably arranged to attract the remote control to an upper portion of the air outlet.

The fan assembly is preferably a bladeless fan assembly. Through use of a bladeless fan assembly an air current can be generated without the use of a bladed fan. In comparison to a bladed fan assembly, the bladeless fan assembly leads to a reduction in both moving parts and complexity. Furthermore, without the use of a bladed fan to project the air current from the fan assembly, a relatively uniform air current can be generated and guided into a room or towards a user. The air current can travel efficiently out from the air outlet, losing little energy and velocity to turbulence.

The term 'bladeless' is used to describe a fan assembly in which air flow is emitted or projected forward from the fan assembly without the use of moving blades. Consequently, a bladeless fan assembly can be considered to have an output area, or emission zone, absent moving blades from which the air flow is directed towards a user or into a room. The output area of the bladeless fan assembly may be supplied with a primary air flow generated by one of a variety of different sources, such as pumps, generators, motors or other fluid transfer devices, and which may include a rotating device such as a motor rotor and/or a bladed impeller for generating the air flow. The generated primary air flow can pass from the room space or other environment outside the fan assembly through the fan assembly to the air outlet, and then back out to the room space through the mouth of the air outlet.

Hence, the description of a fan assembly as bladeless is not intended to extend to the description of the power source and components such as motors that are required for secondary fan functions. Examples of secondary fan functions can include lighting, adjustment and oscillation of the fan assembly.

The shape of the air outlet of the fan assembly is not constrained by the requirement to include space for a bladed fan. Preferably, the air outlet surrounds the opening. The air outlet may be an annular air outlet which preferably has a height in the range from 200 to 600 mm, more preferably in the range from 250 to 500 mm, and the remote control is preferably attachable to the convex outer surface of the annular air outlet.

Where the air outlet comprises a convex outer surface, the remote control preferably comprises a concave outer surface which faces the convex outer surface of the air outlet when the remote control is attached to the air outlet by the magnetic means. This can improve the stability of the remote control when it is located on the air outlet. To further improve the stability of the remote control, the radius of curvature of the concave outer surface of the remote control is preferably no greater than the radiu's of curvature of the convex outer surface of the air outlet. The appearance of the fan assembly when the remote control is attached to the air outlet may be enhanced by shaping the remote control so that it has a convex outer surface located opposite to the concave outer surface. This convex outer surface of the remote control may also have a radius of curvature which is substantially the same as the radius of curvature of the convex outer surface of the air outlet.

A user interface of the remote control is preferably located on the concave outer surface of the remote control, so that the user interfaces is hidden when the remote control is attached to the air outlet. This can prevent accidental operation of the fan assembly through inadvertent contact with the user interface when the remote control is attached to the fan assembly. The user interface may comprise a plurality of user operable buttons which are depressed to control the operation of the fan assembly, such as the activation of the motor and the speed of rotation of the impeller, and/or a touch screen.

The magnetic means for attaching the remote control to the air outlet may comprise at least one magnet located beneath the concave outer surface of the remote control. In a preferred embodiment the remote control comprises a pair of magnets located towards opposite sides of the remote control.

Preferably, the mouth of the air outlet extends about the opening, and is preferably annular. The air outlet preferably comprises an inner casing section and an outer casing section which define the mouth of the air outlet. Each section is preferably formed from a respective annular member, but each section may be provided by a plurality of members connected together or otherwise assembled to form that section.

At least part of the outer casing section may be formed from magnetic material to which the magnets located within the remote control are attracted. For example, an upper part of the outer casing section may be formed, for example, from steel, whereas the remainder of the outer casing section may be formed from a cheaper non-magnetic material, such as aluminium or a plastics material.

Alternatively, the magnetic means may comprise at least one magnet located in the air outlet for attracting the magnet or magnets located in the remote control. For example, the air outlet may comprise at least two magnets angularly spaced about the air outlet. The spacing between these magnets is preferably substantially the same as the spacing between the magnets located in the remote control.

The magnet or magnets located in the air outlet may be located at least partially within the interior passage of the air outlet. The outer casing section may be provided with at least one magnet housing disposed on the inner surface thereof for retaining at least one magnet. For example, the or each magnet housing may comprise a pair of resilient walls extending inwardly from the inner surface of the outer casing section, with the innermost ends of the walls being shaped to retain a magnet which has been inserted between the walls. The magnet housing may extend circumferentially around the inner surface of the outer casing section, and may be arranged to receive a plurality of angularly spaced magnets. Alternatively, a plurality of magnet housings may be angularly spaced about the inner surface of the outer casing section, with each magnet housing being arranged to retain a respective magnet.

The outer casing section is preferably shaped so as to partially overlap the inner casing section. This can enable an outlet of the mouth to be defined between overlapping portions of the external surface of the inner casing section and the internal surface of the outer casing section of the air outlet. The outlet is preferably in the form of a slot, preferably having a width in the range from 0.5 to 5 mm. The air outlet may comprise a plurality of spacers for urging apart the overlapping portions of the inner casing section and the outer casing section of the air outlet. This can assist in maintaining a substantially uniform outlet width about the opening. The spacers are preferably evenly spaced along the outlet.

The interior passage is preferably continuous, more preferably annular, and is preferably shaped to divide the air flow into two air streams which flow in opposite directions around the opening. The interior passage is preferably also defined by the inner casing section and the outer casing section of the air outlet.

The fan assembly preferably comprises means for oscillating the air outlet so that the air current is swept over an arc, preferably in the range from 60 to 120°. For example, the fan assembly may comprise a base which includes means for oscillating an upper part of the base, to which the air outlet is connected, relative to a lower part of the base. The control circuit may be arranged to activate the means for oscillating the air outlet in response to a signal received from the remote control.

The base preferably houses the motor, the impeller and the control circuit. The impeller is preferably a mixed flow impeller. The motor is preferably a DC brushless motor to avoid frictional losses and carbon debris from the brushes used in a traditional brushed motor. Reducing carbon debris and emissions is advantageous in a clean or pollutant sensitive environment such as a hospital or around those with allergies. While induction motors, which are generally used in pedestal fans, also have no brushes, a DC brushless motor can provide a much wider range of operating speeds than an induction motor.

The air outlet preferably comprises a surface located adjacent the mouth and over which the mouth is arranged to direct the air flow emitted therefrom. This surface is preferably a Coanda surface, and the external surface of the inner casing section of the air outlet is preferably shaped to define the Coanda surface. The Coanda surface preferably extends about the opening. A Coanda surface is a type of surface over which fluid flow exiting an output orifice close to the surface exhibits the Coanda effect. The fluid tends to flow over the surface closely, almost 'clinging to' or 'hugging' the surface. The Coanda effect is already a proven, well documented method of entrainment in which a primary air flow is directed over a Coanda surface. A description of the features of a Coanda surface, and the effect of fluid flow over a Coanda surface, can be found in articles such as Reba, Scientific American, Volume 214, June 1963 pages 84 to 92. Through use of a Coanda surface, an increased amount of air from outside the fan assembly is drawn through the opening by the air emitted from the mouth.

In a preferred embodiment an air flow created by the fan assembly enters the air outlet. In the following description this air flow will be referred to as primary air flow. The primary air flow is emitted from the mouth of the air outlet and passes over the Coanda surface. The primary air flow entrains air surrounding the mouth of the air outlet, which acts as an air amplifier to supply both the primary air flow and the entrained air to the user. The entrained air will be referred to here as a secondary air flow. The secondary air flow is drawn from the room space, region or external environment surrounding the mouth of the air outlet and, by displacement, from other regions around the fan assembly, and passes predominantly through the opening defined by the air outlet. The primary air flow directed over the Coanda surface combined with the entrained secondary air flow equates to a total air flow emitted or projected forward from the opening defined by the air outlet. Preferably, the entrainment of air surrounding the mouth of the air outlet is such that the primary air flow is amplified by at least five times, more preferably by at least ten times, while a smooth overall output is maintained.

Preferably, the air outlet comprises a diffuser surface located downstream of the Coanda surface. The external surface of the inner casing section of the air outlet is preferably shaped to define the diffuser surface.

The fan assembly may be in the form of a tower fan. Alternatively, the fan assembly may be in the form of a pedestal fan, and so the base may form part of an adjustable pedestal connected to the air outlet. The pedestal may comprise a duct for conveying the air flow to the air outlet. Thus, the pedestal may serve both to support the air outlet through which an air flow created by the fan assembly is emitted and to convey the created air flow to the air outlet. The location of the motor and the impeller towards the bottom of the pedestal can lower the center of gravity of the fan assembly in comparison to prior art pedestal fans where a bladed fan and drive apparatus for the bladed fan are connected to the top of the pedestal, thereby rendering the fan assembly less prone to falling over if knocked.

The remote control may be attached to the air outlet by means other than magnets, for example through mechanical means for securing the remote control to the air outlet. In a second aspect the present invention provides a fan assembly for creating an air current, the fan assembly comprising an air inlet, an air outlet, an impeller, a motor for rotating the impeller to create an air flow passing from the air inlet to the air outlet, the air outlet comprising an interior passage for receiving the air flow and a mouth for emitting the air flow, the air outlet defining an opening through which air from outside the fan assembly is drawn by the air flow emitted from the mouth, a control circuit for controlling the motor, a remote control for transmitting control signals to the control circuit, and a system for attaching the remote control to the air outlet, and wherein the remote control comprises a concave outer surface and the air outlet comprises a convex outer surface which faces the concave outer surface of the remote control when the remote control is attached to the air outlet.

Features described above in connection with the first aspect of the invention are equally applicable to the second aspect of the invention, and vice versa.

BRIEF DESCRIPTION OF THE DRAWINGS

An embodiment of the present invention will now be described, by way of example only, with reference to the accompanying drawings, in which.

DETAILED DESCRIPTION OF THE INVENTION

Figure 2:
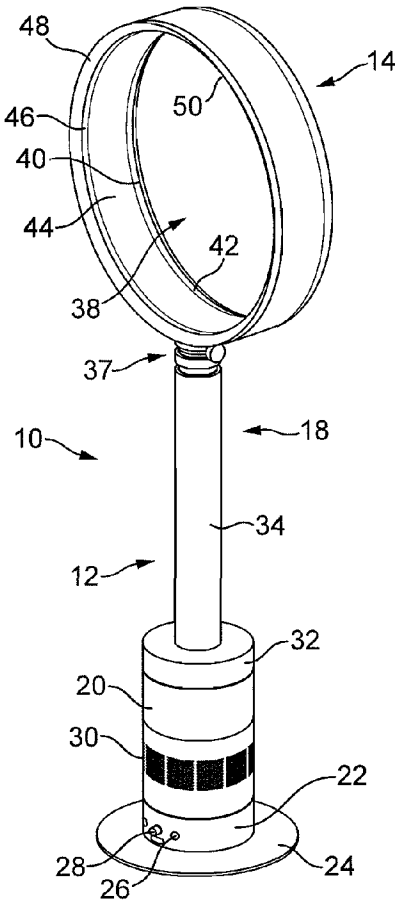
FIG. 2 is another perspective view of the fan assembly of FIG. 1, in which the telescopic duct of the fan assembly is in a retracted position.
Figure 1:
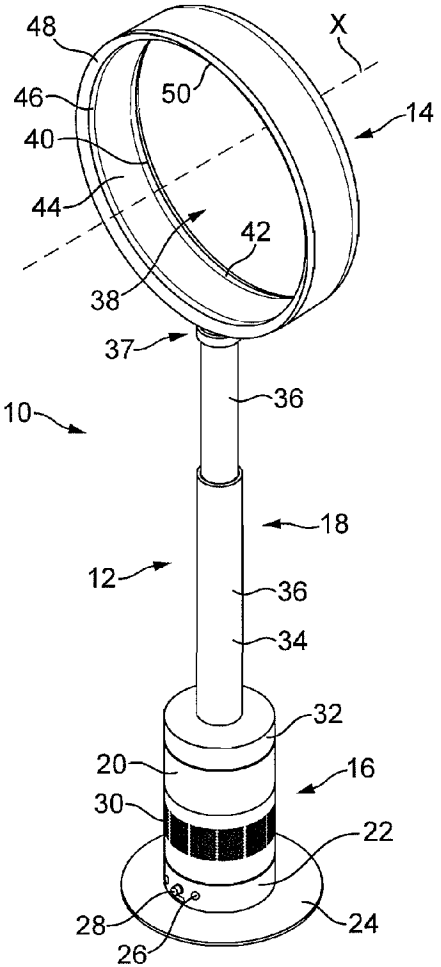
FIG. 1 is a perspective view of a fan assembly, in which a telescopic duct of the fan assembly is in a fully extended configuration.

FIGS. 1 and 2 illustrate perspective views of an embodiment of a fan assembly 10. In this embodiment, the fan assembly 10 is a bladeless fan assembly, and is in the form of a domestic pedestal fan comprising a height adjustable pedestal 12 and an air outlet in the form of a nozzle 14 mounted on the pedestal 12 for emitting air from the fan assembly 10. The pedestal 12 comprises a base 16 and a telescopic duct 18 extending upwardly from the base 16 for conveying a primary air flow from the base 16 to the nozzle 14.

The base 16 of the pedestal 12 comprises a substantially cylindrical motor casing portion 20 mounted on a substantially cylindrical lower casing portion 22. The motor casing portion 20 and the lower casing portion 22 preferably have substantially the same external diameter so that the external surface of the motor casing portion 20 is substantially flush with the external surface of the lower casing portion 22. The lower casing portion 22 is mounted optionally on a disc-shaped base plate 24, and comprises a plurality of user-operable buttons 26 and a user-operable dial 28 for controlling the operation of the fan assembly 10. The base 16 further comprises a plurality of air inlets 30, which in this embodiment are in the form of apertures formed in the motor casing portion 20 and through which a primary air flow is drawn into the base 16 from the external environment. In this embodiment the base 16 of the pedestal 12 has a height in the range from 200 to 300 mm, and the motor casing portion 20 has a diameter in the range from 100 to 200 mm. The base plate 24 preferably has a diameter in the range from 200 to 300 mm.

The telescopic duct 18 of the pedestal 12 is moveable between a fully extended configuration, as illustrated in FIG.

1, and a retracted configuration, as illustrated in FIG. 2. The duct 18 comprises a substantially cylindrical base 32 mounted on the base 12 of the fan assembly 10, an outer tubular member 34 which is connected to, and extends upwardly from, the base 32, and an inner tubular member 36 which is located partially within the outer tubular member 34. A connector 37 connects the nozzle 14 to the open upper end of the inner tubular member 36 of the duct 18. The inner tubular member 36 is slidable relative to, and within, the outer tubular member 34 between a fully extended position, as illustrated in FIG. 1, and a retracted position, as illustrated in FIG. 2. When the inner tubular member 36 is in the fully extended position, the fan assembly 10 preferably has a height in the range from 1200 to 1600 mm, whereas when the inner tubular member 36 is in the retracted position, the fan assembly 10 preferably has a height in the range from 900 to 1300 mm. To adjust the height of the fan assembly 10, the user may grasp an exposed portion of the inner tubular member 36 and slide the inner tubular member 36 in either an upward or a downward direction as desired so that nozzle 14 is at the desired vertical position. When the inner tubular member 36 is in its retracted position, the user may grasp the connector 37 to pull the inner tubular member 36 upwards.

The nozzle 14 has an annular shape, extending about a central axis X to define an opening 38. The nozzle 14 comprises a mouth 40 located towards the rear of the nozzle 14 for emitting the primary air flow from the fan assembly 10 and through the opening 38. The mouth 40 extends about the opening 38, and is preferably also annular. The inner periphery of the nozzle 14 comprises a Coanda surface 42 located adjacent the mouth 40 and over which the mouth 40 directs the air emitted from the fan assembly 10, a diffuser surface 44 located downstream of the Coanda surface 42 and a guide surface 46 located downstream of the diffuser surface 44. The diffuser surface 44 is arranged to taper away from the central axis X of the opening 38 in such a way so as to assist the flow of air emitted from the fan assembly 10. The angle subtended between the diffuser surface 44 and the central axis X of the opening 38 is in the range from 5 to 25°, and in this example is around 7°. The guide surface 46 is arranged at an angle to the diffuser surface 44 to further assist the efficient delivery of a cooling air flow from the fan assembly 10. The guide surface 46 is preferably arranged substantially parallel to the central axis X of the opening 38 to present a substantially flat and substantially smooth face to the air flow emitted from the mouth 40. A visually appealing tapered surface 48 is located downstream from the guide surface 46, terminating at a tip surface 50 lying substantially perpendicular to the central axis X of the opening 38. The angle subtended between the tapered surface 48 and the central axis X of the opening 38 is preferably around 45°. In this embodiment, the nozzle 14 has a height in the range from 400 to 600 mm.

Figure 3:
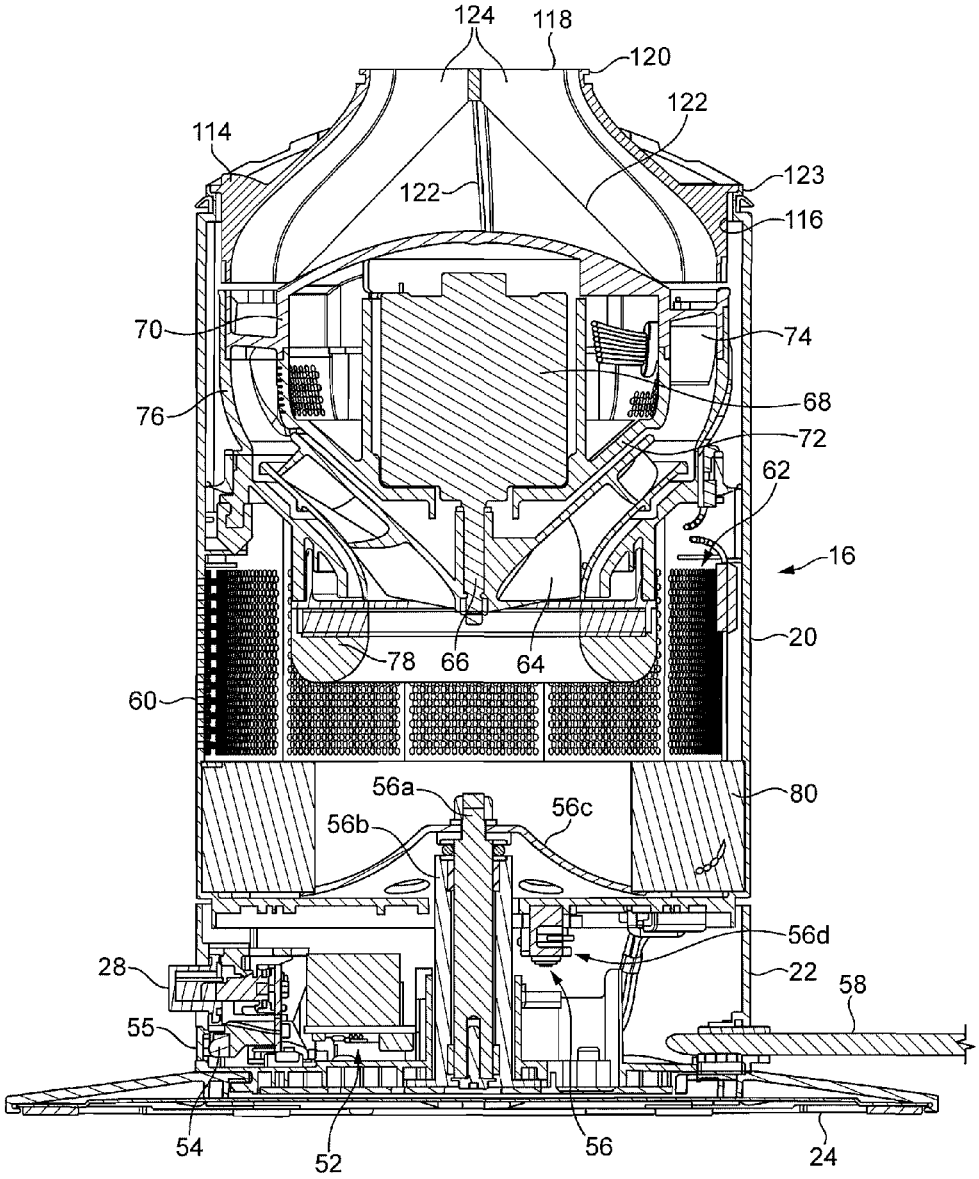
FIG. 3 is a sectional view of the base of the pedestal of the fan assembly of FIG. 1.

FIG. 3 illustrates a sectional view through the base 16 of the pedestal 12. The lower casing portion 22 of the base 16 houses a control circuit, indicated generally at 52, for controlling the operation of the fan assembly 10 in response to depression of the user operable buttons 26 shown in FIGS. 1 and 2, and/or manipulation of the user operable dial 28. The lower casing portion 22 may optionally comprise a sensor 54 for receiving control signals from a remote control 250, which is described in more detail below, and for conveying these control signals to the control circuit 52. These control signals are preferably infrared signals. The sensor 54 is located behind a window 55 through which the control signals enter the lower casing portion 22 of the base 16. A light emitting diode (not shown) may be provided for indicating whether the fan assembly 10 is in a stand-by mode.

The lower casing portion 22 also houses a mechanism, indicated generally at 56, for oscillating the motor casing portion 20 of the base 16 relative to the lower casing portion 22 of the base 16. The operation of the oscillating mechanism 56 is controlled by the control circuit 52, again in response to depression of one of the user operable buttons 26 or upon receipt of an appropriate control signal from the remote control 250. The oscillating mechanism 56 comprises a rotatable shaft 56*a* which extends from the lower casing portion 22 into the motor casing portion 20. The shaft 56*a* is supported within a sleeve 56*b* connected to the lower casing portion 22 by bearings to allow the shaft 56*a* to rotate relative to the sleeve 56*b*. One end of the shaft 56*a* is connected to the central portion of an annular connecting plate 56*c*, whereas the outer portion of the connecting plate 56*c* is connected to the base of the motor casing portion 20. This allows the motor casing portion 20 to be rotated relative to the lower casing portion 22. The oscillating mechanism 56 also comprises a motor (not shown) located within the lower casing portion 22 which operates a crank arm mechanism, indicated generally at 56*d*, which oscillates the base of the motor casing portion 20 relative to an upper portion of the lower casing portion 22. Crack arm mechanisms for oscillating one part relative to another are generally well known, and so will not be described here. The range of each oscillation cycle of the motor casing portion 20 relative to the lower casing portion 22 is preferably between 60° and 120°, and in this embodiment is around 90°. In this embodiment, the oscillating mechanism 56 is arranged to perform around 3 to 5 oscillation cycles per minute. A mains power cable 58 extends through an aperture formed in the lower casing portion 22 for supplying electrical power to the fan assembly 10.

The motor casing portion 20 comprises a cylindrical grille 60 in which an array of apertures 62 is formed to provide the air inlets 30 of the base 16 of the pedestal 12. The motor casing portion 20 houses an impeller 64 for drawing the primary air flow through the apertures 62 and into the base 16. Preferably, the impeller 64 is in the form of a mixed flow impeller. The impeller 64 is connected to a rotary shaft 66 extending outwardly from a motor 68. In this embodiment, the motor 68 is a DC brushless motor having a speed which is variable by the control circuit 52 in response to user manipulation of the dial 28 and/or a signal received from the remote control 250. The maximum speed of the motor 68 is preferably in the range from 5,000 to 10,000 rpm. The motor 68 is housed within a motor bucket comprising an upper portion 70 connected to a lower portion 72. The upper portion 70 of the motor bucket comprises a diffuser 74 in the form of a stationary disc having spiral blades. The motor bucket is located within, and mounted on, a generally frusto-conical impeller housing 76 connected to the motor casing portion 20. The impeller 64 and the impeller housing 76 are shaped so that the impeller 64 is in close proximity to, but does not contact, the inner surface of the impeller housing 76. A substantially annular inlet member 78 is connected to the bottom of the impeller housing 76 for guiding the primary air flow into the impeller housing 76.

Preferably, the base 16 of the pedestal 12 further comprises silencing foam for reducing noise emissions from the base 16. In this embodiment, the motor casing portion 20 of the base 16 comprises a first, generally cylindrical foam member 80 located beneath the grille 60, a second, substantially annular foam member 82 located between the impeller housing 76 and the inlet member 78, and a third, substantially annular foam member 84 located within the motor bucket.

The telescopic duct 18 of the pedestal 12 will now be described in more detail with reference to FIGS. 4 to 11. The base 32 of the duct 18 comprises a substantially cylindrical side wall 102 and an annular upper surface 104 which is substantially orthogonal to, and preferably integral with, the side wall 102. The side wall 102 preferably has substantially the same external diameter as the motor casing portion 20 of the base 16, and is shaped so that the external surface of the side wall 102 is substantially flush with the external surface of the motor casing portion 20 of the base 16 when the duct 18 is connected to the base 16. The base 32 further comprises a relatively short air pipe 106 extending upwardly from the upper surface 104 for conveying the primary air flow into the outer tubular member 34 of the duct 18. The air pipe 106 is preferably substantially co-axial with the side wall 102, and has an external diameter which is slightly smaller than the internal diameter of the outer tubular member 34 of the duct 18 to enable the air pipe 106 to be fully inserted into the outer tubular member 34 of the duct 18. A plurality of axially-extending ribs 108 may be located on the outer surface of the air pipe 106 for forming an interference fit with the outer tubular member 34 of the duct 18 and thereby secure the outer tubular member 34 to the base 32. An annular sealing member 110 is located over the upper end of the air pipe 106 to form an air-tight seal between the outer tubular member 34 and the air pipe 106.

The duct 18 comprises a domed air guiding member 114 for guiding the primary air flow emitted from the diffuser 74 into the air pipe 106. The air guiding member 114 has an open lower end 116 for receiving the primary air flow from the base 16, and an open upper end 118 for conveying the primary air flow into the air pipe 106. The air guiding member 114 is housed within the base 32 of the duct 18. The air guiding member 114 is connected to the base 32 by means of co-operating snap-fit connectors 120 located on the base 32 and the air guiding member 114. A second annular sealing member 121 is located about the open upper end 118 for forming an air-tight seal between the base 32 and the air guiding member 114. As illustrated in FIG. 3, the air guiding member 114 is connected to the open upper end of the motor casing portion 20 of the base 16, for example by means of co-operating snap-fit connectors 123 or screw-threaded connectors located on the air guiding member 114 and the motor casing portion 20 of the base 16. Thus, the air guiding member 114 serves to connect the duct 18 to the base 16 of the pedestal 12.

Figure 4:
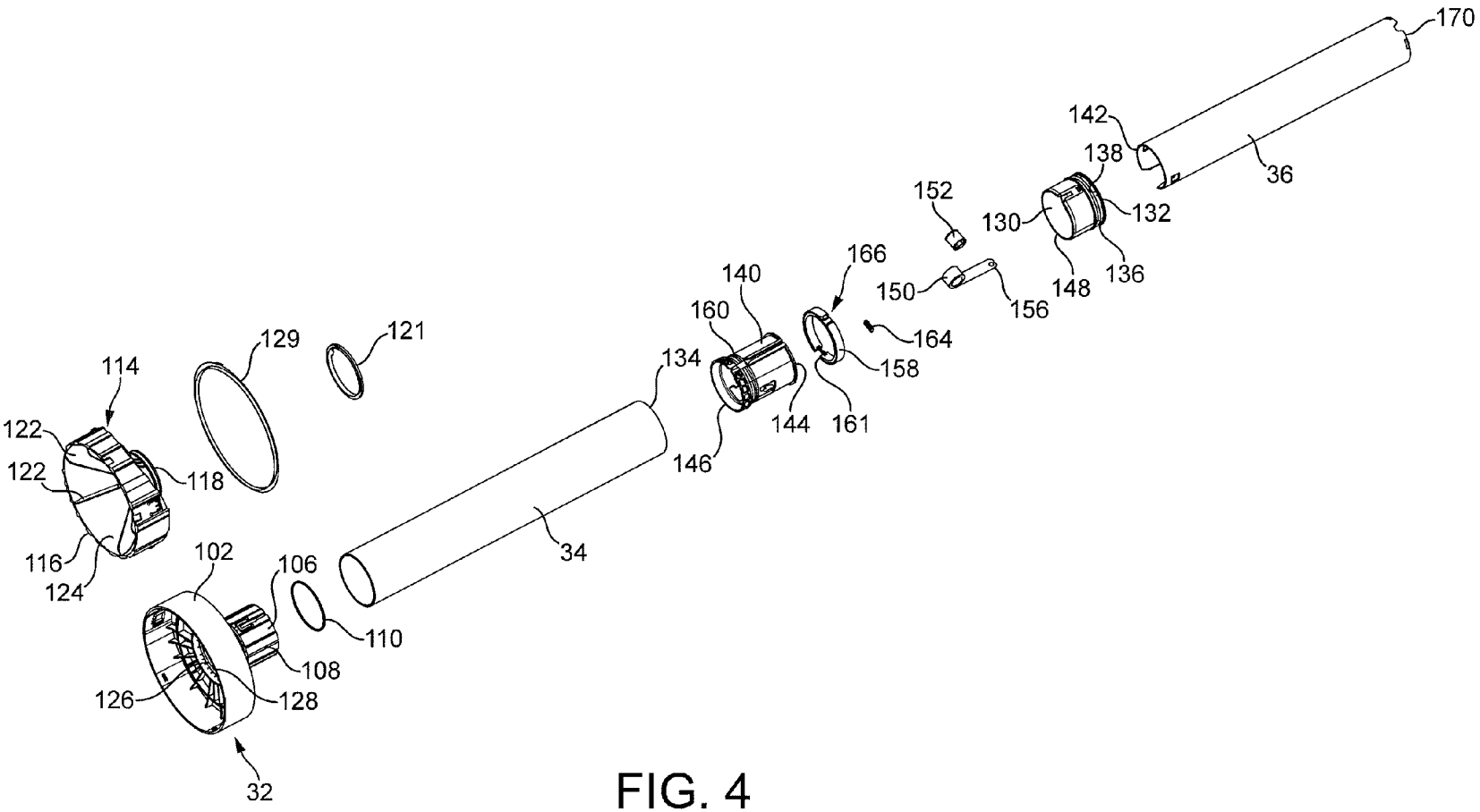
FIG. 4 is an exploded view of the telescopic duct of the fan assembly of FIG. 1.

A plurality of air guiding vanes 122 are located on the inner surface of the air guiding member 114 for guiding the spiraling air flow emitted from the diffuser 74 into the air pipe 106. In this example, the air guiding member 114 comprises seven air guiding vanes 122 which are evenly spaced about the inner surface of the air guiding member 114. The air guiding vanes 122 meet at the center of the open upper end 118 of the air guiding member 114, and thus define a plurality of air channels 124 within the air guiding member 114 each for guiding a respective portion of the primary air flow into the air pipe 106. With particular reference to FIG. 4, seven radial air guiding vanes 126 are located within the air pipe 106. Each of these radial air guiding vanes 126 extends along substantially the entire length of the air pipe 126, and adjoins a respective one of the air guiding vanes 122 when the air guiding member 114 is connected to the base 32. The radial air guiding vanes 126 thus define a plurality of axially-extending air channels 128 within the air pipe 106 which each receive a respective portion of the primary air flow from a respective one of the air channels 124 within the air guiding member 114, and which convey that portion of the primary flow axially through the air pipe 106 and into the outer tubular member 34 of the duct 18. Thus, the base 32 and the air guiding member 114 of the duct 18 serve to convert the spiraling air flow emitted from the diffuser 74 into an axial air flow which passes through the outer tubular member 34 and the inner tubular member 36 to the nozzle 14. A third annular sealing member 129 may be provided for forming an air-tight seal between the air guiding member 114 and the base 32 of the duct 18.

A cylindrical upper sleeve 130 is connected, for example using an adhesive or through an interference fit, to the inner surface of the upper portion of the outer tubular member 34 so that the upper end 132 of the upper sleeve 130 is level with the upper end 134 of the outer tubular member 34. The upper sleeve 130 has an internal diameter which is slightly greater than the external diameter of the inner tubular member 36 to allow the inner tubular member 36 to pass through the upper sleeve 130. A third annular sealing member 136 is located on the upper sleeve 130 for forming an air-tight seal with the inner tubular member 36. The third annular sealing member 136 comprises an annular lip 138 which engages the upper end 132 of the outer tubular member 34 to form an air-tight seal between the upper sleeve 130 and the outer tubular member 34.

A cylindrical lower sleeve 140 is connected, for example using an adhesive or through an interference fit, to the outer surface of the lower portion of the inner tubular member 36 so that the lower end 142 of the inner tubular member 36 is located between the upper end 144 and the lower end 146 of the lower sleeve 140. The upper end 144 of the lower sleeve 140 has substantially the same external diameter as the lower end 148 of the upper sleeve 130. Thus, in the fully extended position of the inner tubular member 36 the upper end 144 of the lower sleeve 140 abuts the lower end 148 of the upper sleeve 130, thereby preventing the inner tubular member 36 from being withdrawn fully from the outer tubular member 34. In the retracted position of the inner tubular member 36, the lower end 146 of the lower sleeve 140 abuts the upper end of the air pipe 106.

Figure 5:
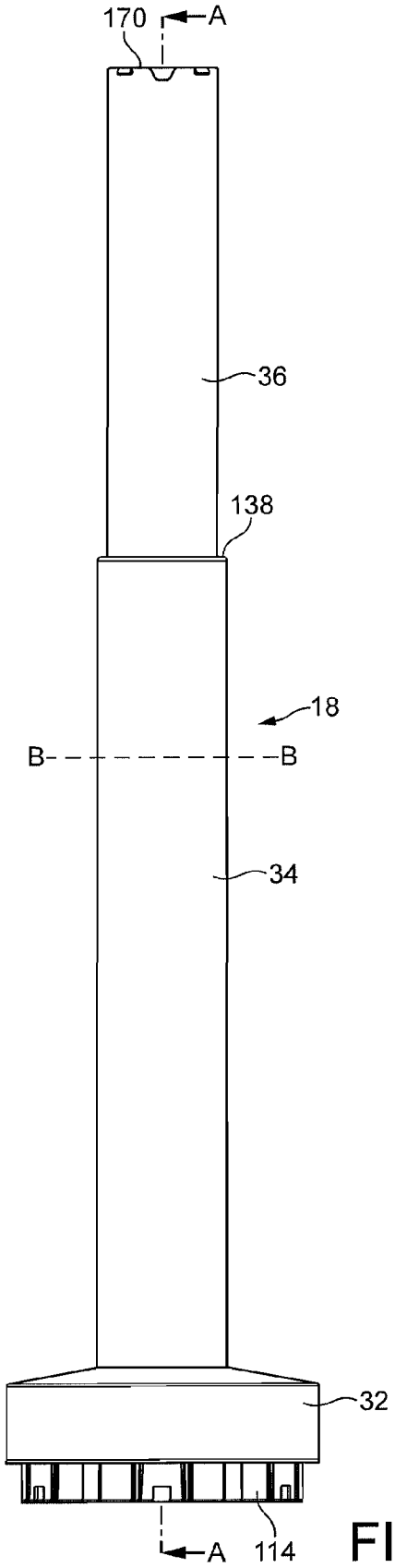
FIG. 5 is a side view of the duct of FIG. 4 in a fully extended configuration.
Figure 6:
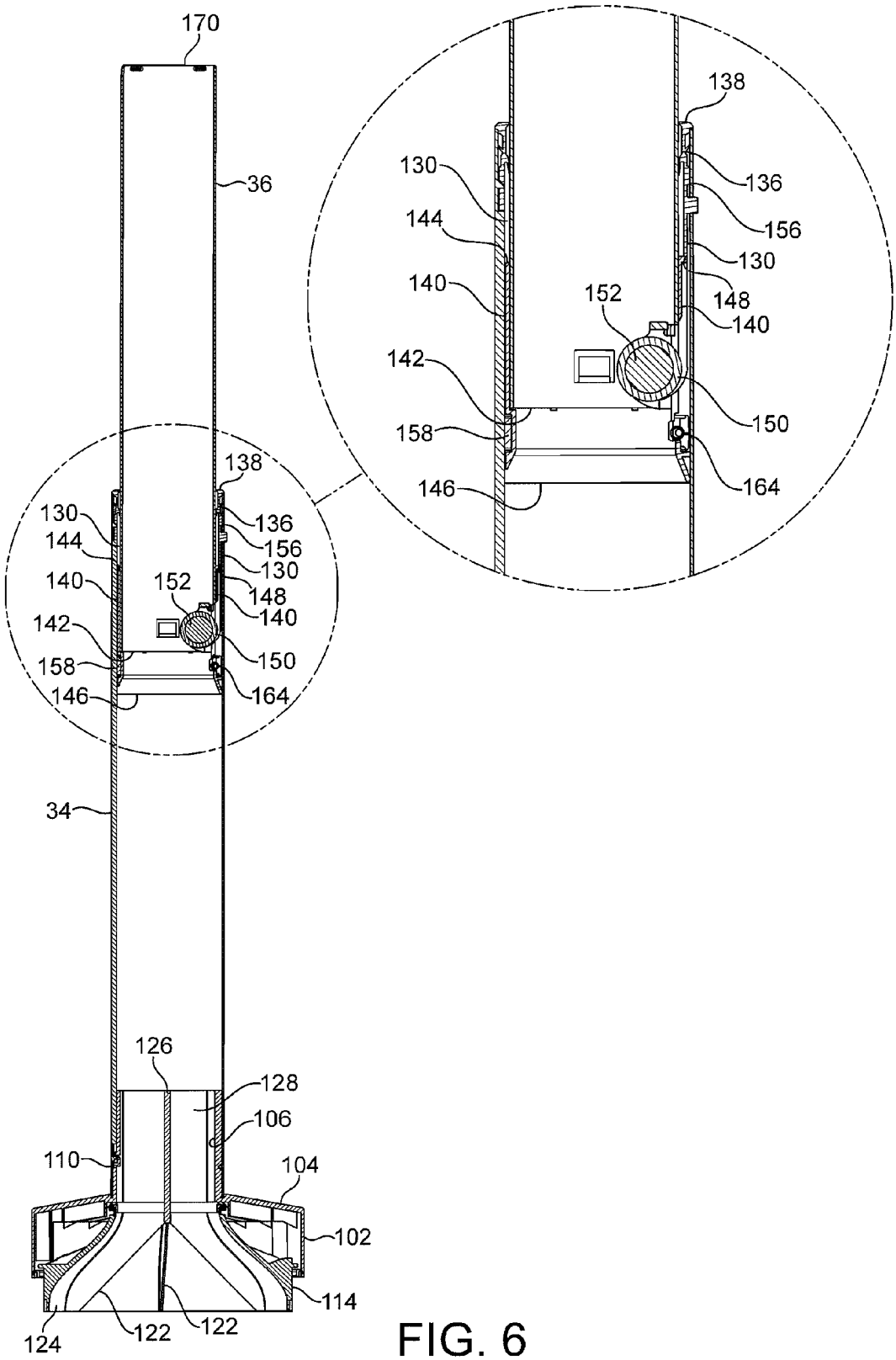
FIG. 6 is a sectional view of the duct taken along line A-A in FIG. 5.
Figure 7:
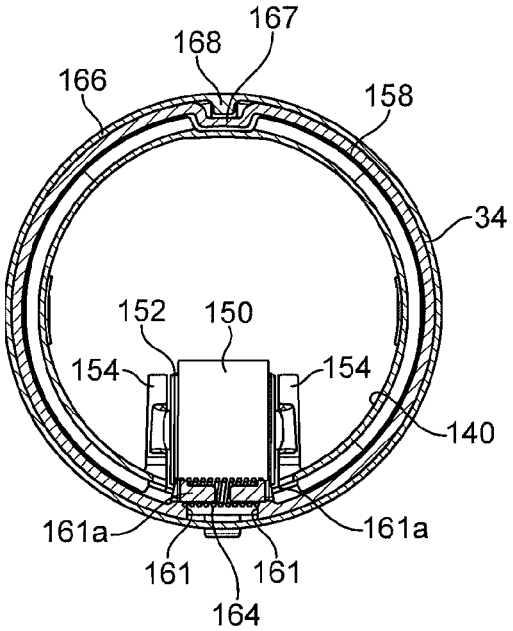
FIG. 7 is a sectional view of the duct taken along line B-B in FIG. 5.
Figure 8:
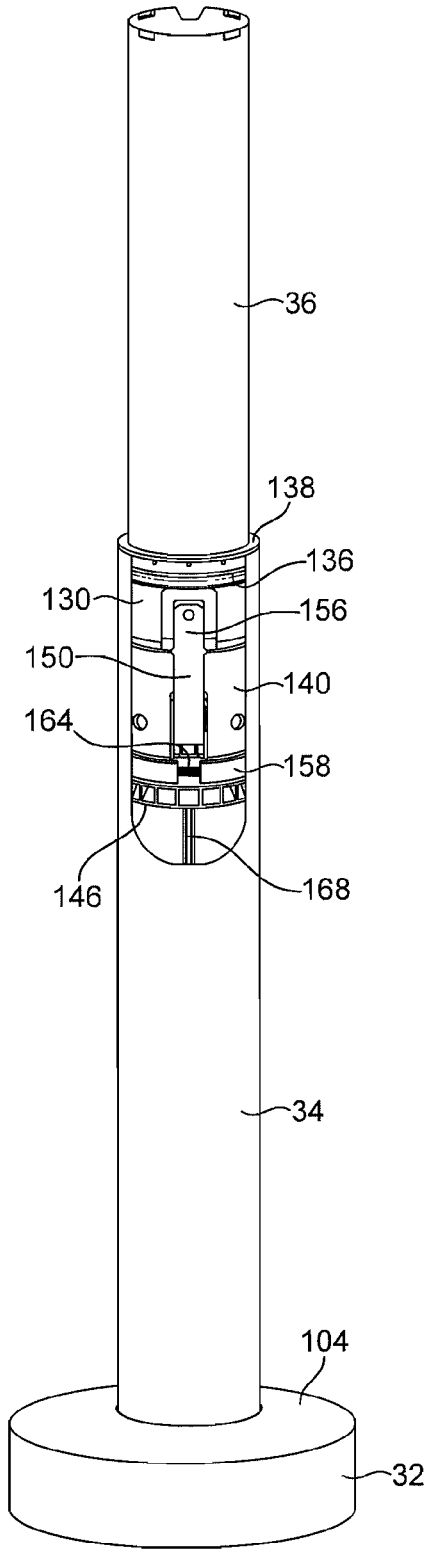
FIG. 8 is a perspective view of the duct of FIG. 4 in a fully extended configuration, with part of the lower tubular member cut away.
Figure 10:
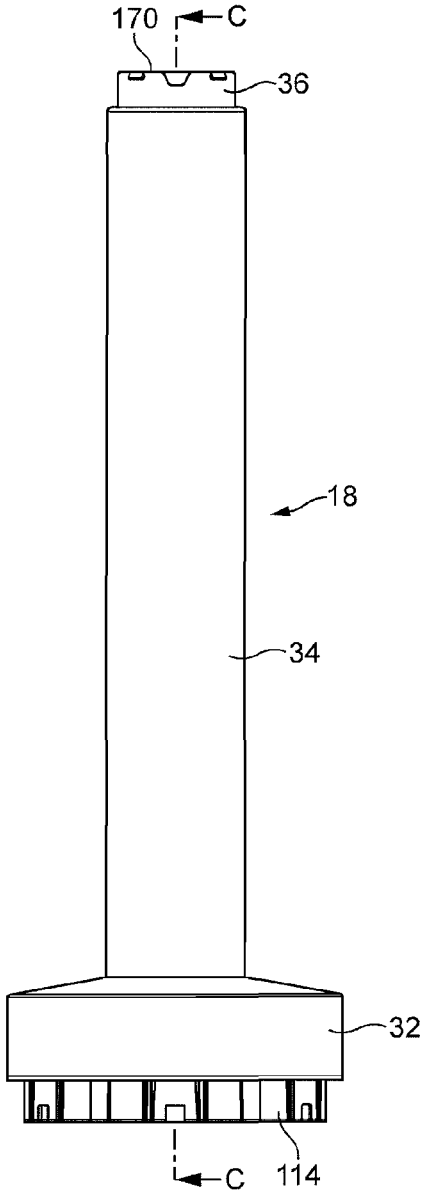
FIG. 10 is a side view of the duct of FIG. 4 in a retracted configuration.
Figure 11:
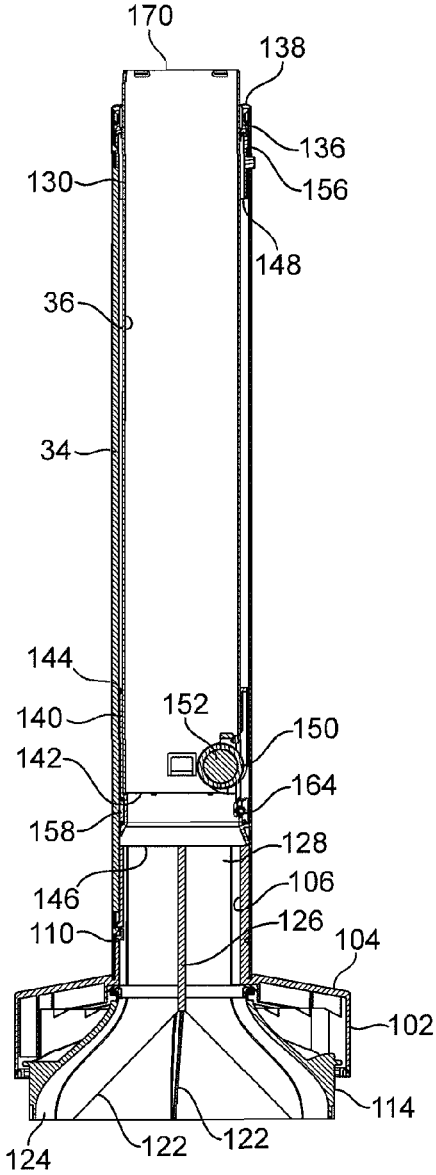
FIG. 11 is a sectional view of the duct taken along line C-C in FIG. 10.
Figure 12:
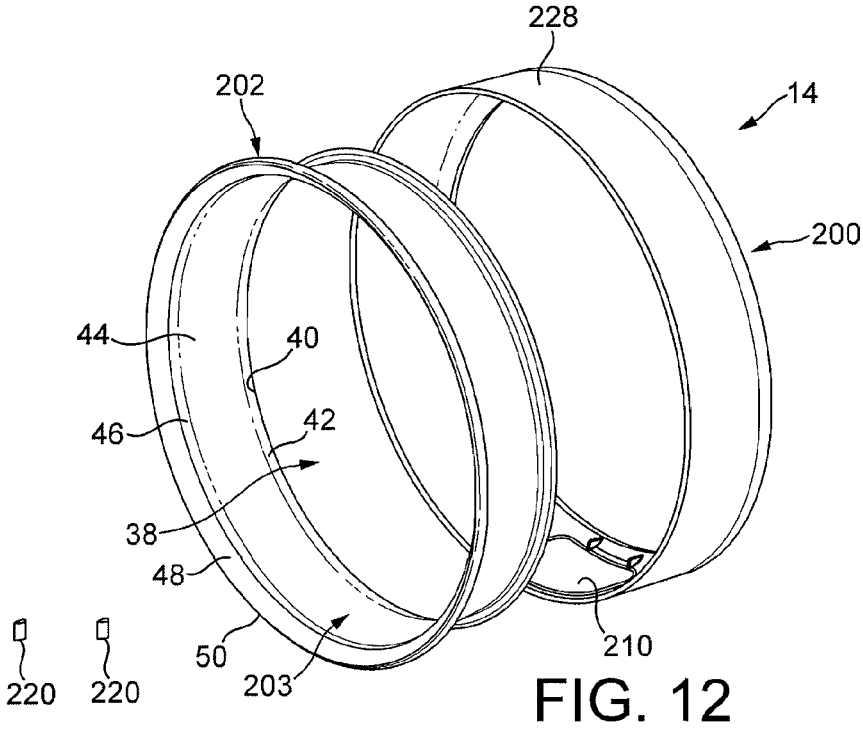
FIG. 12 is an exploded view of the nozzle of the fan assembly of FIG. 1.

A mainspring 150 is coiled around an axle 152 which is rotatably supported between inwardly extending arms 154 of the lower sleeve 140 of the duct 18, as illustrated in FIG. 7. With reference to FIG. 8, the mainspring 150 comprises a steel strip which has a free end 156 fixedly located between the external surface of the upper sleeve 130 and the internal surface of the outer tubular member 34. Consequently, the mainspring 150 is unwound from the axle 152 as the inner tubular member 36 is lowered from the fully extended position, as illustrated in FIGS. 5 and 6, to the retracted position, as illustrated in FIGS. 10 and 11. The elastic energy stored within the mainspring 150 acts as a counter-weight for maintaining a user-selected position of the inner tubular member 36 relative to the outer tubular member 34.

Figure 9:
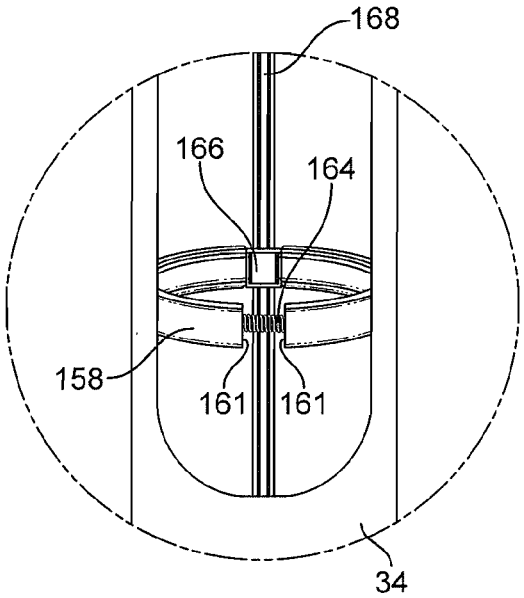
FIG. 9 is an enlarged view of part of FIG. 8, with various parts of the duct removed.

Additional resistance to the movement of the inner tubular member 36 relative to the outer tubular member 34 is provided by a spring-loaded, arcuate band 158, preferably formed from plastics material, located within an annular groove 160 extending circumferentially about the lower sleeve 140. With reference to FIGS. 7 and 9, the band 158 does not extend fully about the lower sleeve 140, and so comprises two opposing ends 161. Each end 161 of the band 158 comprises a radially inner portion 161*a* which is received within an aperture 162 formed in the lower sleeve 140. A compression spring 164 is located between the radially inner portions 161*a* of the ends 161 of the band 158 to urge the external surface of the band 158 against the internal surface of the outer tubular member 34, thereby increasing the frictional forces which resist movement of the inner tubular member 36 relative to the outer tubular member 34.

The band 158 further comprises a grooved portion 166, which in this embodiment is located opposite to the compression spring 164, which defines an axially extending groove 167 on the external surface of the band 158. The groove 167 of the band 158 is located over a raised rib 168 which extends axially along the length of its internal surface of the outer tubular member 34. The groove 167 has substantially the same angular width and radial depth as the raised rib 168 to inhibit relative rotation between the inner tubular member 36 and the outer tubular member 34.

The nozzle 14 of the fan assembly 10 will now be described with reference to FIGS. 12 to 18. The nozzle 14 comprises an annular outer casing section 200 connected to and extending about an annular inner casing section 202. Each of these sections may be formed from a plurality of connected parts, but in this embodiment each of the outer casing section 200 and the inner casing section 202 is formed from a respective, single molded part. The inner casing section 202 defines the central opening 38 of the nozzle 14, and has an external peripheral surface 203 which is shaped to define the Coanda surface 42, diffuser surface 44, guide surface 46 and tapered surface 48.

Figure 13:
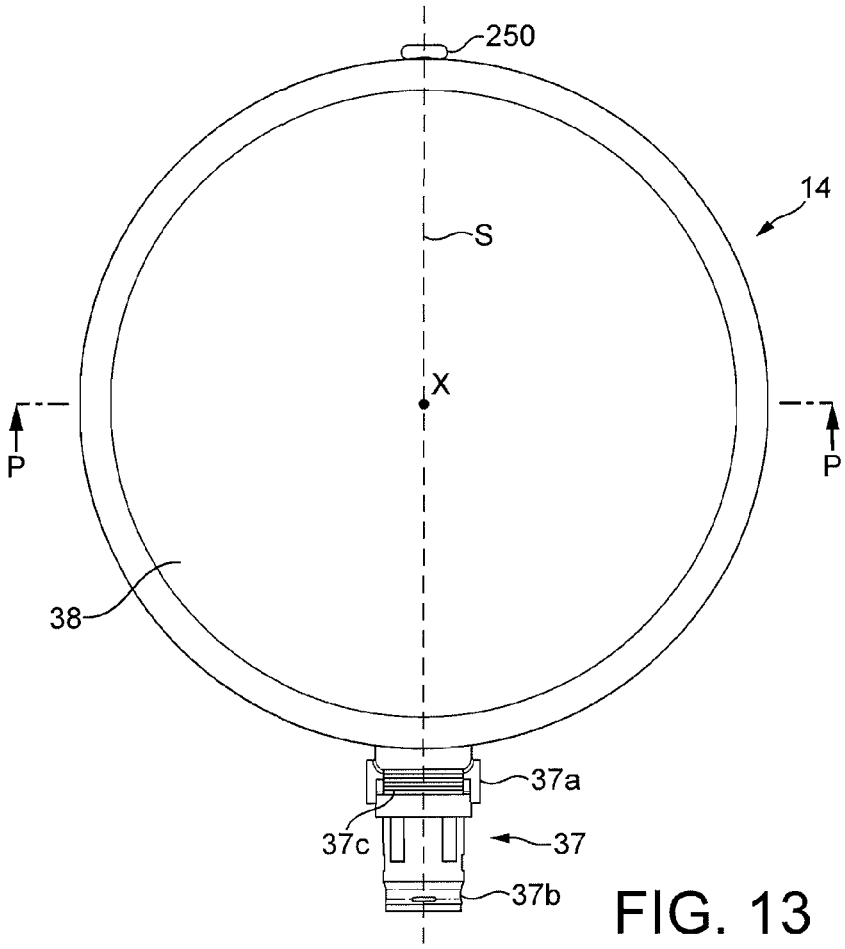
FIG. 13 is a front view of the nozzle of FIG. 12.
Figure 14:
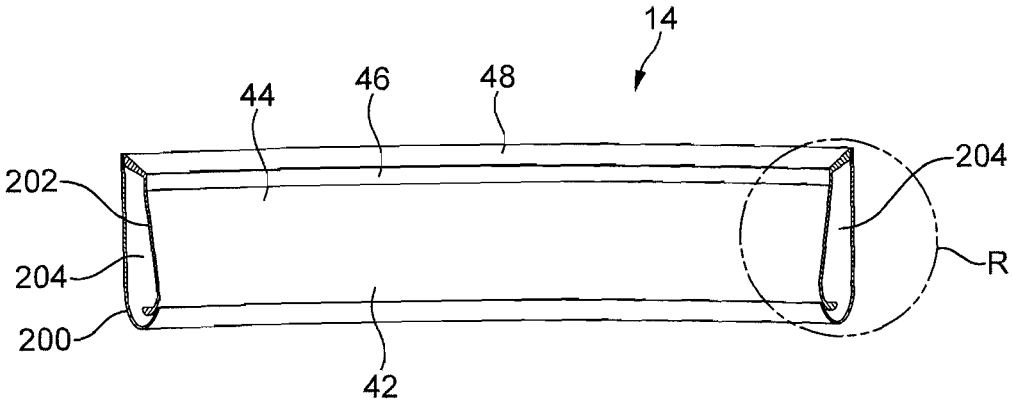
FIG. 14 is a sectional view of the nozzle, taken along line P-P in FIG. 13.
Figure 15:
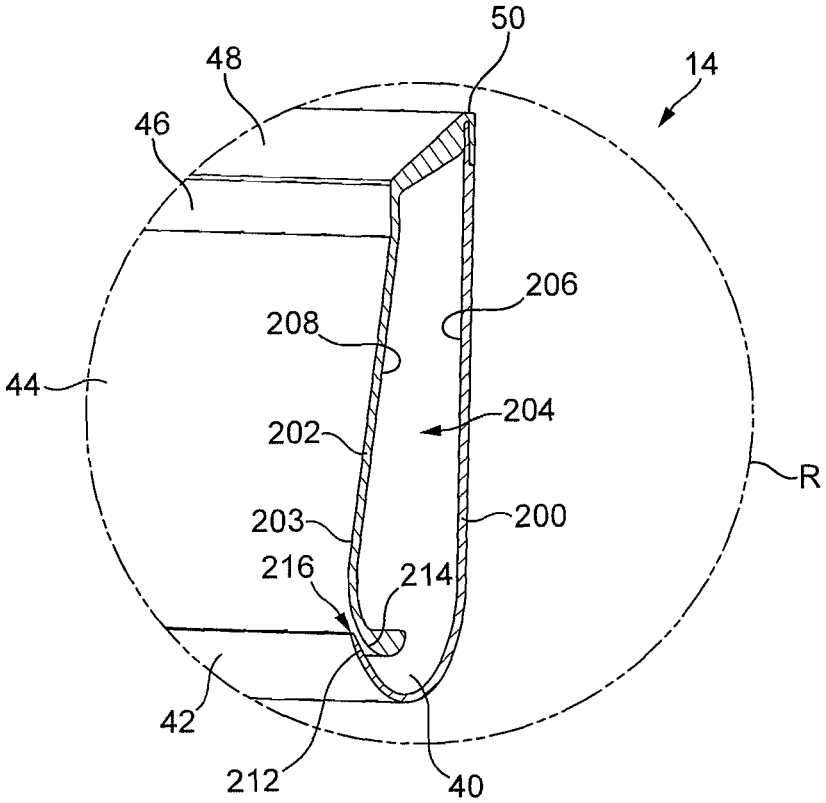
FIG. 15 is an enlarged view of area R indicated in FIG. 14.

With particular reference to FIGS. 13 to 15, the outer casing section 200 and the inner casing section 202 together define an annular interior passage 204 of the nozzle 14. Thus, the interior passage 204 extends about the opening 38. The interior passage 204 is bounded by the internal peripheral surface 206 of the outer casing section 200 and the internal peripheral surface 208 of the inner casing section 202. The base of the outer casing section 200 comprises an aperture 210. The connector 37 which connects the nozzle 14 to the open upper end 170 of the inner tubular member 36 of the duct 18 comprises an upper plate 37*a* which is fixedly located within the aperture 210, and which comprises a circular aperture through which the primary air flow enters the interior passage 204 from the telescopic duct 18. The connector 37 further comprises an air pipe 37*b* which is at least partially inserted through the open upper end 170 of the inner tubular member 36, and which is connected to the upper plate 37*a* of the connector. This air pipe 37*b* has substantially the same internal diameter as the circular aperture formed in the upper plate 37*a* of the connector 37. A flexible hose 37*c* is located between the air pipe 37*b* and the upper plate 37*a* for forming an air-tight seal therebetween.

The mouth 40 of the nozzle 14 is located towards the rear of the nozzle 10. The mouth 40 is defined by overlapping, or facing, portions 212, 214 of the internal peripheral surface 206 of the outer casing section 200 and the external peripheral surface 203 of the inner casing section 202, respectively. In this example, the mouth 40 is substantially annular and, as illustrated in FIG. 15, has a substantially U-shaped cross-section when sectioned along a line passing diametrically through the nozzle 14. In this example, the overlapping portions 212, 214 of the internal peripheral surface 206 of the outer casing section 200 and the external peripheral surface 203 of the inner casing section 202 are shaped so that the mouth 40 tapers towards an outlet 216 arranged to direct the primary flow over the Coanda surface 42. The outlet 216 is in the form of an annular slot, preferably having a relatively constant width in the range from 0.5 to 5 mm. In this example the outlet 216 has a width in the range from 0.5 to 1.5 mm. Spacers 218 may be spaced about the mouth 40 for urging apart the overlapping portions 212, 214 of the internal peripheral surface 206 of the outer casing section 200 and the external peripheral surface 203 of the inner casing section 202 to maintain the width of the outlet 216 at the desired level. These spacers may be integral with either the internal peripheral surface 206 of the outer casing section 200 or the external peripheral surface 203 of the inner casing section 202.

With reference now to FIGS. 12 and 16 to 18, the nozzle 14 also comprises a pair of magnets 220 for attaching the remote control 250 to the nozzle 14. Each magnet 220 is substantially cylindrical in shape, and is retained within a respective magnet housing 222 disposed on the inner peripheral surface 206 of the outer casing section 200. The magnet housings 222 are circumferentially spaced about the inner peripheral surface 206 of the outer casing section 200. As shown most clearly in FIG. 18, the magnet housings 222 are equally spaced from the vertical plane of symmetry S of the nozzle 14. Each magnet housing 222 comprises a pair of curved resilient walls 224 which protrude inwardly from the inner peripheral surface 206 of the outer casing section 200. The walls 224 are shaped so that the inner diameter of the magnet housing 222 is slightly greater than the external diameter of the magnet 220. The distal ends 226 of the walls 224 which are remote from the inner peripheral surface 206 of the outer casing section 200 protrude radially inwardly with respect to the walls 224, When a magnet 220 is pushed into the magnet housing 222 through an aperture 228 defined by the distal ends 226 of the walls 224, the walls 224 deflect outwardly to allow the magnet 220 to enter the magnet housing 222, and when the magnet 220 is located fully within the magnet housing 222 the walls 224 relax so that the magnet 220 is retained within the magnet housing 222 by the distal ends 226 of the walls 224. When the magnets 220 are located within the magnet housings 222, the magnets 220 are located at least partially within the interior passage 204 of the nozzle 14.

Figure 16:
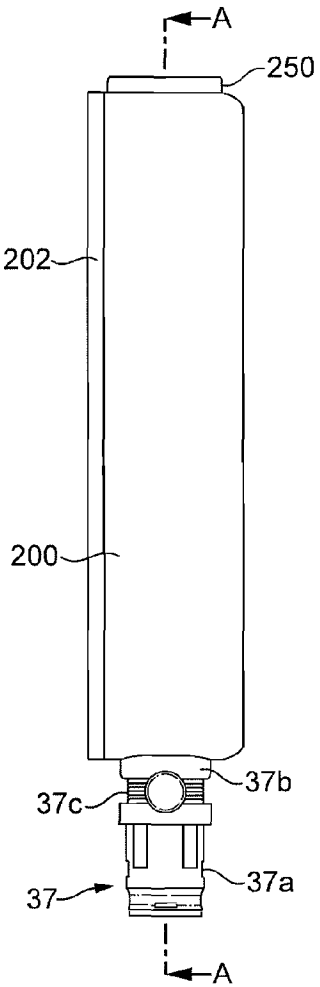
FIG. 16 is a side view of the nozzle of FIG. 12.
Figure 21:
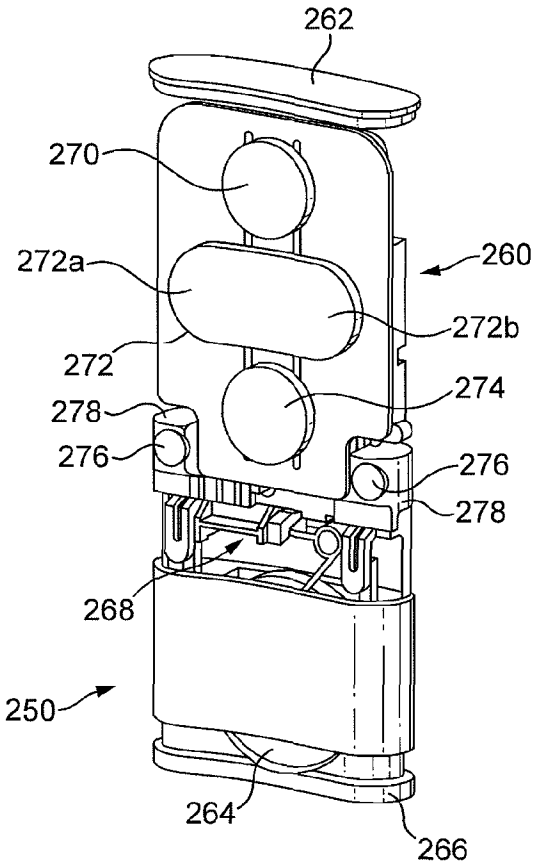
FIG. 21 is a perspective view of the remote control of FIG. 19 with the outer casing section removed.
Figure 20:
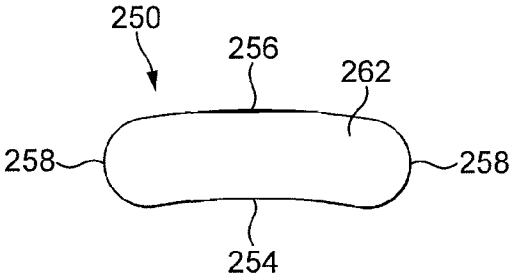
FIG. 20 is an end view of the remote control of FIG. 19.
Figure 19:
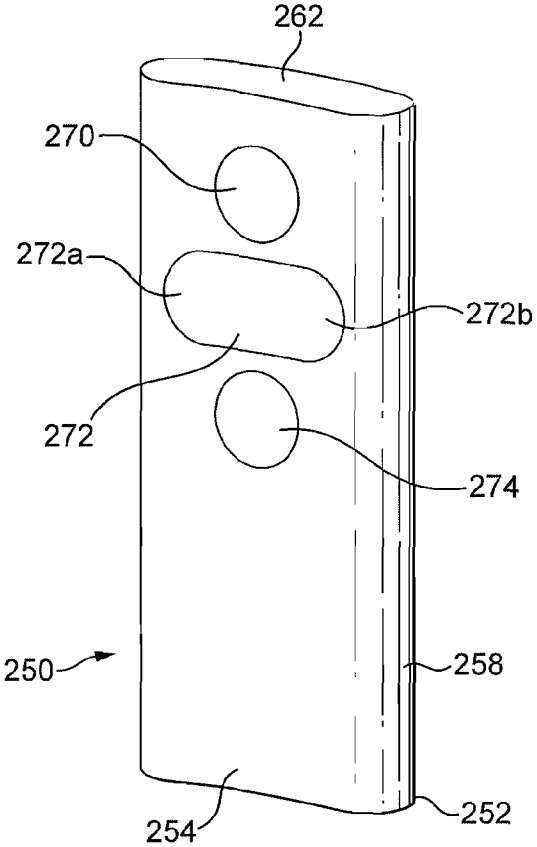
FIG. 19 is a perspective view of a remote control for controlling the fan assembly of FIG. 1.

FIGS. 13 and 16 illustrate the remote control 250 when it is attached to the nozzle 14, whereas FIGS. 19 to 21 illustrate the remote control 250 in more detail. The remote control 250 comprises an outer housing 252 having a front surface 254, a rear surface 256 and two curved side walls 258 each extending between the front surface 254 and the rear surface 256. The front surface 254 is concave, and the rear surface 256 is convex. The radius of curvature of the front surface 254 is substantially the same as the radius of curvature of the rear surface 256, and is preferably smaller than or equal to the radius of curvature of the external peripheral surface 228 of the outer casing section 200.

The remote control 250 comprises a user interface for enabling a user to control the operation of the fan assembly 10. In this example the user interface comprises a plurality of buttons which are depressible by the user, and which are each accessible via a respective window formed in the front surface 254 of the housing 252. The remote control 250 comprises a control unit, indicated generally at 260 in FIGS. 18 and 21, for generating and transmitting infra-red control signals in response to depression of one of the buttons of the user interface. The control unit 260 is largely conventional and so will not be described in detail here. The infra-red signals are emitted from a window 262 located at one end of the remote control 250. The control unit 260 is powered by a battery 264 located within a battery housing 266 which is releasably retained in the outer housing 252 by a retention mechanism 268.

A first button 270 of the user interface is an on/off button for the fan assembly 10, and in response to the depression of this button the control unit 260 transmits a signal instructing the control unit 52 of the fan assembly 10 to activate or deactivate the motor 68 depending on its current state. A second button 272 of the user interface enables the user to control the rotational speed of the motor 68, and thereby control the air flow generated by the fan assembly 10. In response to the depression of a first side 272*a* of the second button 272 the control unit 260 transmits a signal instructing the control unit 52 of the fan assembly 10 to decrease the speed of the motor 68, whereas in response to the depression of a second side 272*b* of the second button 272 the control unit 260 transmits a signal instructing the control unit 52 of the fan assembly 10 to increase the speed of the motor 68. A third button 274 of the user interface is an on/off button for the oscillating mechanism 56, and in response to the depression of this button the control unit 260 transmits a signal instructing the control unit 52 of the fan assembly 10 to activate or deactivate the oscillating mechanism 56 depending on its current state. If the motor 68 is inactive when this third button 274 is depressed, the control unit 52 may be arranged to activate simultaneously the oscillating mechanism 56 and the motor 68.

Figure 17:
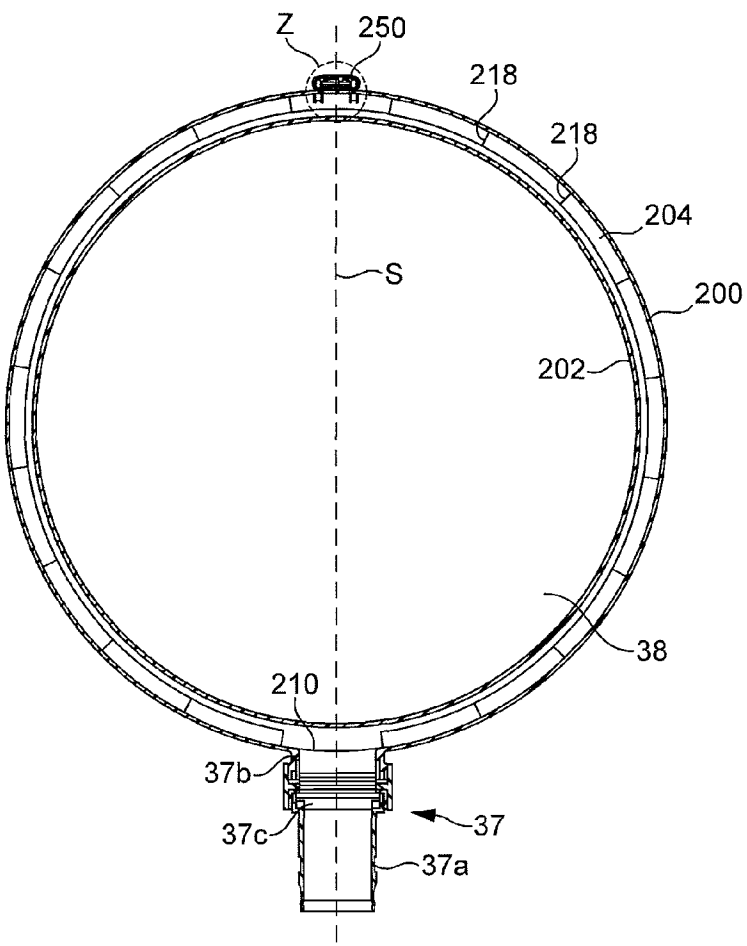
FIG. 17 is a sectional view of the nozzle, taken along line A-A in FIG. 16.
Figure 18:
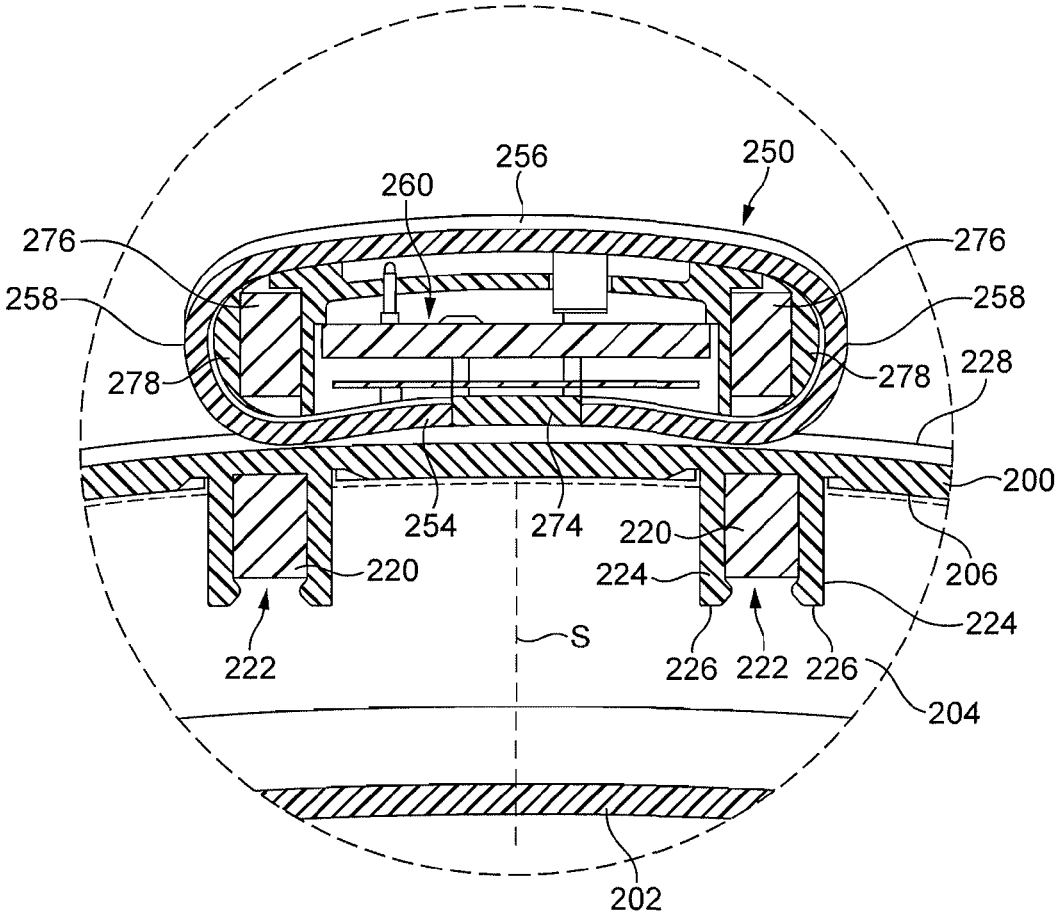
FIG. 18 is an enlarged view of area Z indicated in FIG. 17.

The outer housing 252 of the remote control 250 is preferably formed from plastics material, and so the remote control 250 includes at least one magnet which is attracted to the magnets 220 of the nozzle 14 so that the remote control 250 can be attached to the nozzle 14. In this example, the remote control 250 comprises a pair of magnets 276 each located within a magnet housing 278 disposed towards a respective side of the remote control 250. With reference to FIGS. 16 to 18, the spacing between the magnets 276 of the remote control 250 is substantially the same as the spacing between the magnets 220 of the nozzle 14. The magnets 276 are positioned so that when the remote control 250 is located on the upper surface of the nozzle 14, the remote control 250 is held in such a position that that remote control 250 does not protrude beyond either the front or the rear edge of the nozzle 14. This reduces the likelihood of the remote control 250 being accidentally dislodged from the nozzle 14. The polarity of the magnets 276 is selected so that the concave front surface 254 of the remote control 250 faces the outer peripheral surface 228 of the outer section 200 of the nozzle 14 when the remote control 250 is attached to the nozzle 14. This can inhibit accidental operation of the buttons of the user interface when the remote control 250 is attached to the nozzle 14.

The magnetic force between the magnets 220, 276 is preferably less than 2 N, and more preferably in the range from 0.25 to 1 N to minimize the likelihood of the fan assembly being displaced when the remote control is subsequently detached from the air outlet.

The provision of a plurality of spaced magnets in both the nozzle 14 and the remote control 250 also has the effect of providing a plurality of angularly spaced "docking positions" for the remote control 250 on the nozzle 14. In this example in which the nozzle 14 and the remote control 250 each include two magnets, this arrangement can provide three angularly spaced docking positions for the remote control 250 on the nozzle 14. The remote control 250 has a first docking position, illustrated in FIGS. 13 and 16 to 18, in which each of the magnets 276 of the remote control 250 is located over a respective one of the magnets 220 of the nozzle 14. The remote control 250 also has a second docking position and a third docking position, each located to a respective side of the first docking position, in which only one of the magnets 276 of the remote control 250 is located over a respective one of the magnets 220 of the nozzle 14. The provision of a plurality of docking positions can reduce the accuracy with which the user is required to position the remote control 250 for attachment to the nozzle 14, and thus be more convenient for the user.

To operate the fan assembly 10, the user depresses an appropriate one of the buttons 26 on the base 16 of the pedestal 12, or the button 260 on the remote control 250, in response to which the control circuit 52 activates the motor 68 to rotate the impeller 64. The rotation of the impeller 64 causes a primary air flow to be drawn into the base 16 of the pedestal 12 through the apertures 62 of the grille 60. Depending on the speed of the motor 68, the primary air flow may be between 20 and 40 liters per second. The primary air flow passes sequentially through the impeller housing 76 and the diffuser 74. The spiral form of the blades of the diffuser 74 causes the primary air flow to be exhausted from the diffuser 74 in the form of spiraling air flow. The primary air flow enters the air guiding member 114, wherein the curved air guiding vanes 122 divide the primary air flow into a plurality of portions, and guide each portion of the primary air flow into a respective one of the axially-extending air channels 128 within the air pipe 106 of the base 32 of the telescopic duct 18. The portions of the primary air flow merge into an axial air flow as they are emitted from the air pipe 106. The primary air flow passes upwards through the outer tubular member 34 and the inner tubular member 36 of the duct 18, and through the connector 37 to enter the interior passage 86 of the nozzle 14.

Within the nozzle 14, the primary air flow is divided into two air streams which pass in opposite directions around the central opening 38 of the nozzle 14. As the air streams pass through the interior passage 204, air enters the mouth 40 of the nozzle 14. The air flow into the mouth 40 is preferably substantially even about the opening 38 of the nozzle 14. Within the mouth 40, the flow direction of the air stream is substantially reversed. The air stream is constricted by the tapering section of the mouth 40 and emitted through the outlet 216.

The primary air flow emitted from the mouth 40 is directed over the Coanda surface 42 of the nozzle 14, causing a secondary air flow to be generated by the entrainment of air from the external environment, specifically from the region around the outlet 216 of the mouth 40 and from around the rear of the nozzle 14. This secondary air flow passes through the central opening 38 of the nozzle 14, where it combines with the primary air flow to produce a total air flow, or air current, projected forward from the nozzle 14.

The even distribution of the primary air flow along the mouth 40 of the nozzle 14 ensures that the air flow passes evenly over the diffuser surface 44. The diffuser surface 44 causes the mean speed of the air flow to be reduced by moving the air flow through a region of controlled expansion. The relatively shallow angle of the diffuser surface 44 to the central axis X of the opening 38 allows the expansion of the air flow to occur gradually. A harsh or rapid divergence would otherwise cause the air flow to become disrupted, generating vortices in the expansion region. Such vortices can lead to an increase in turbulence and associated noise in the air flow which can be undesirable, particularly in a domestic product such as a fan. The air flow projected forwards beyond the diffuser surface 44 can tend to continue to diverge. The presence of the guide surface 46 extending substantially parallel to the central axis X of the opening 38 further converges the air flow. As a result, the air flow can travel efficiently out from the nozzle 14, enabling the air flow can be experienced rapidly at a distance of several meters from the fan assembly 10.

The invention claimed is:

1. A fan assembly for creating an air current, the fan assembly comprising:

an air inlet;

an air outlet;

an impeller;

a motor for rotating the impeller to create an air flow passing from the air inlet to the air outlet, the air outlet comprising an interior passage for receiving the air flow and a mouth for emitting the air flow, the air outlet defining an opening through which air from outside the fan assembly is drawn by the air flow emitted from the mouth;

a control circuit for controlling the motor;

a remote control for transmitting control signals to the control circuit; and at least one magnet for attaching the remote control to the air outlet, wherein said at least one magnet is located in the air outlet, and wherein the air outlet comprises an annular inner casing section and an annular outer casing section which together define the interior passage and the mouth, and wherein said at least one magnet is located within a housing disposed on an inner surface of the outer casing section.

2. The fan assembly of claim 1, wherein said at least one magnet is arranged to attach the remote control to an upper portion of the air outlet.

3. The fan assembly of claim 1, wherein said at least one magnet comprises at least two magnets angularly spaced about the air outlet.

4. The fan assembly of claim 1, wherein the housing comprises a pair of resilient walls extending inwardly from the inner surface of the outer casing section for retaining at least one magnet therebetween.

5. The fan assembly of claim 1, wherein the outer casing section comprises a plurality of said housings angularly spaced about the inner surface of the outer casing section, each housing being arranged to retain a respective magnet.

6. The fan assembly of claim 1, wherein the mouth comprises an outlet located between an external surface of the inner casing section and an internal surface of the outer casing section.

7. The fan assembly of claim 6, wherein the outlet is in the form of a slot.

8. The fan assembly of claim 6, wherein the outlet has a width in the range from 0.5 to 5 mm.

9. The fan assembly of claim 1, wherein the remote control comprises a concave outer surface and the air outlet comprises a convex outer surface which faces the concave outer surface of the remote control when the remote control is attached to the air outlet by the magnetic means.

10. The fan assembly of claim 9, wherein the concave outer surface of the remote control has a radius of curvature which is substantially the same as the radius of curvature of the convex outer surface of the air outlet.

11. The fan assembly of claim 9, wherein the concave outer surface of the remote control comprises a user interface.

12. The fan assembly of claim 11, wherein the remote control comprises at least one magnet located beneath the concave outer surface of the remote control.

13. The fan assembly of claim 9, wherein the remote control comprises a convex outer surface located opposite to the concave outer surface.

14. The fan assembly of claim 13, wherein the convex outer surface of the remote control has a radius of curvature which is substantially the same as the radius of curvature of the concave outer surface of the remote control.

15. The fan assembly of claim 1, wherein said at least one magnet is arranged so that the force required to remove the remote control from the air outlet is less than 2 N.

16. The fan assembly of claim 1, wherein said at least one magnet is arranged so that the force required to remove the remote control from the air outlet is less than 1 N.

* * * * *